US007762547B2

(12) United States Patent
Nireki

(10) Patent No.: US 7,762,547 B2
(45) Date of Patent: Jul. 27, 2010

(54) BILL PROCESSING APPARATUS

(75) Inventor: Takao Nireki, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 0 days.

(21) Appl. No.: 12/201,388

(22) Filed: Aug. 29, 2008

(65) Prior Publication Data

US 2009/0057094 A1 Mar. 5, 2009

(30) Foreign Application Priority Data

Sep. 3, 2007 (JP) ..... 2007-227540
Oct. 24, 2007 (JP) ..... 2007-276600

(51) Int. Cl.
*B65H 9/00* (2006.01)

(52) U.S. Cl. ..... 271/240; 271/234

(58) Field of Classification Search ..... 271/234, 271/240

See application file for complete search history.

(56) References Cited

U.S. PATENT DOCUMENTS

| | | | | |
|---|---|---|---|---|
| 4,506,879 | A | 3/1985 | Goodwin et al. | |
| 4,533,134 | A * | 8/1985 | Galster | 271/240 |
| 4,657,239 | A * | 4/1987 | Ikesue et al. | 271/227 |
| 5,368,147 | A * | 11/1994 | Menke et al. | 194/206 |
| 5,411,252 | A * | 5/1995 | Lowell | 271/240 |
| 5,510,909 | A * | 4/1996 | Morikawa et al. | 358/498 |
| 5,516,093 | A * | 5/1996 | Ballard et al. | 271/240 |
| 5,927,702 | A * | 7/1999 | Ishii et al. | 271/9.09 |
| 6,149,150 | A * | 11/2000 | Onipchenko et al. | 271/240 |
| 6,164,642 | A * | 12/2000 | Onipchenko et al. | 271/240 |
| 6,279,900 | B1 * | 8/2001 | Yamagishi | 271/240 |
| 6,402,139 | B1 * | 6/2002 | Kanno | 271/240 |
| 2006/0163801 | A1 | 7/2006 | Dejong et al. | |

FOREIGN PATENT DOCUMENTS

| | | |
|---|---|---|
| EP | 0 171 924 | 2/1986 |
| GB | 2 317 881 | 4/1998 |
| GB | 2 336 358 | 10/1999 |
| JP | 2002-279487 | 9/2002 |
| WO | 9110975 | 7/1991 |

* cited by examiner

*Primary Examiner*—Patrick Mackey
*Assistant Examiner*—Prasad V Gokhale
(74) *Attorney, Agent, or Firm*—Oblon, Spivak, McClelland, Maier & Neustadt, L.L.P.

(57) ABSTRACT

A bill processing apparatus comprising: movable pieces that are movable toward a center of a bill traveling route through which a bill is conveyed by a driving source, and regulate side edges of the bill to be conveyed so as to make the bill aligned in parallel with a conveyance direction, and a control device that controls driving of the driving source is provided. Here, the control means drives the driving source to move the movable pieces toward the center of the bill traveling route from a position at which the movable pieces touch the side edges of the bill after the bill passes the movable pieces.

3 Claims, 21 Drawing Sheets

BILL PROCESSING APPARATUS

CROSS REFERENCE TO RELATED APPLICATIONS

This application is based upon and claims the benefits of priorities from Japanese Patent Application Nos. 2007-227540 and 2007-276600 filed on Sep. 3, 2007 and Oct. 24, 2007, respectively, the entire contents of which are incorporated herein by reference.

FIELD OF THE INVENTION

The present invention relates to a bill processing apparatus comprising a skew correction mechanism in which a bill is accurately positioned with respect to a bill identification part and also a bill processing apparatus capable of preventing a fraudulent activity by utilizing the skew correction mechanism.

RELATED ART

In general, a bill processing apparatus is incorporated into a service device, such as a game medium lending machine installed in a game hall, a vending machine or a ticket-vending machine installed in a public space, or the like, that identifies the validity of a bill inserted from a bill insertion slot by a user, and provides various types of products and services in accordance with a value of the bill judged as valid. Such a bill processing apparatus includes a bill conveyance mechanism that carries a bill inserted into a bill insertion slot, operating devices such as a bill identification part and the like that judges the validity of the bill to be carried, and a control means that drives and controls the operating devices as disclosed in Japanese patent application publication No. 2002-279487, for example.

This bill identification part is so configured that the identification sensor such as a line sensor read the bill being transferred and the output from the sensor is compared to the official data so as to judge the validity and it is required to transfer the bill in the accurate condition without inclination (correcting the inclination of the bill to the direction of the transfer and hereafter being referred to as skew correction) in order for the sensor to read all bills with the homogenous condition. And widths of bills may differ depending on kinds thereof such that it is necessary to transfer each bill to the identification part in a condition where an accurate alignment (e.g., centering) is made in order to assure the reading accuracy.

Meanwhile, with respect to a bill processing apparatus as described above, it can be considered that a fraudulent activity such as drawing back a bill inserted into a bill insertion slot is committed by a user, and therefore, it is necessary to take measures to prevent such a fraudulent activity from occurring. In detail, for example, after a bill is inserted into an apparatus main body, a blocking member to block the bill insertion slot, a stopper member for preventing drawing, or the like may be installed in a bill traveling route in order not to allow someone to draw out a bill.

SUMMARY OF THE INVENTION

In accordance with the present invention, it is possible to obtain a bill processing apparatus capable of preventing a fraudulent activity at low cost.

In the present invention, a bill processing apparatus comprising: movable pieces that are movable toward a center of a bill traveling route through which a bill is conveyed by a driving source, and regulate side edges of the bill to be conveyed so as to make the bill aligned in parallel with a conveyance direction, and a control device that controls driving of the driving source is provided. Here, the control means drives the driving source to move the movable pieces toward the center of the bill traveling route from a position at which the movable pieces touch the side edges of the bill after the bill passes the movable pieces.

Further features of the present invention, its nature, and various advantages will be more apparent from the accompanying drawings and the following description of the preferred embodiment.

DETAILED DESCRIPTION OF THE PREFERRED EMBODIMENT

Hereinafter, one embodiment of the present invention will be described with reference to the drawings.

Figure 1:
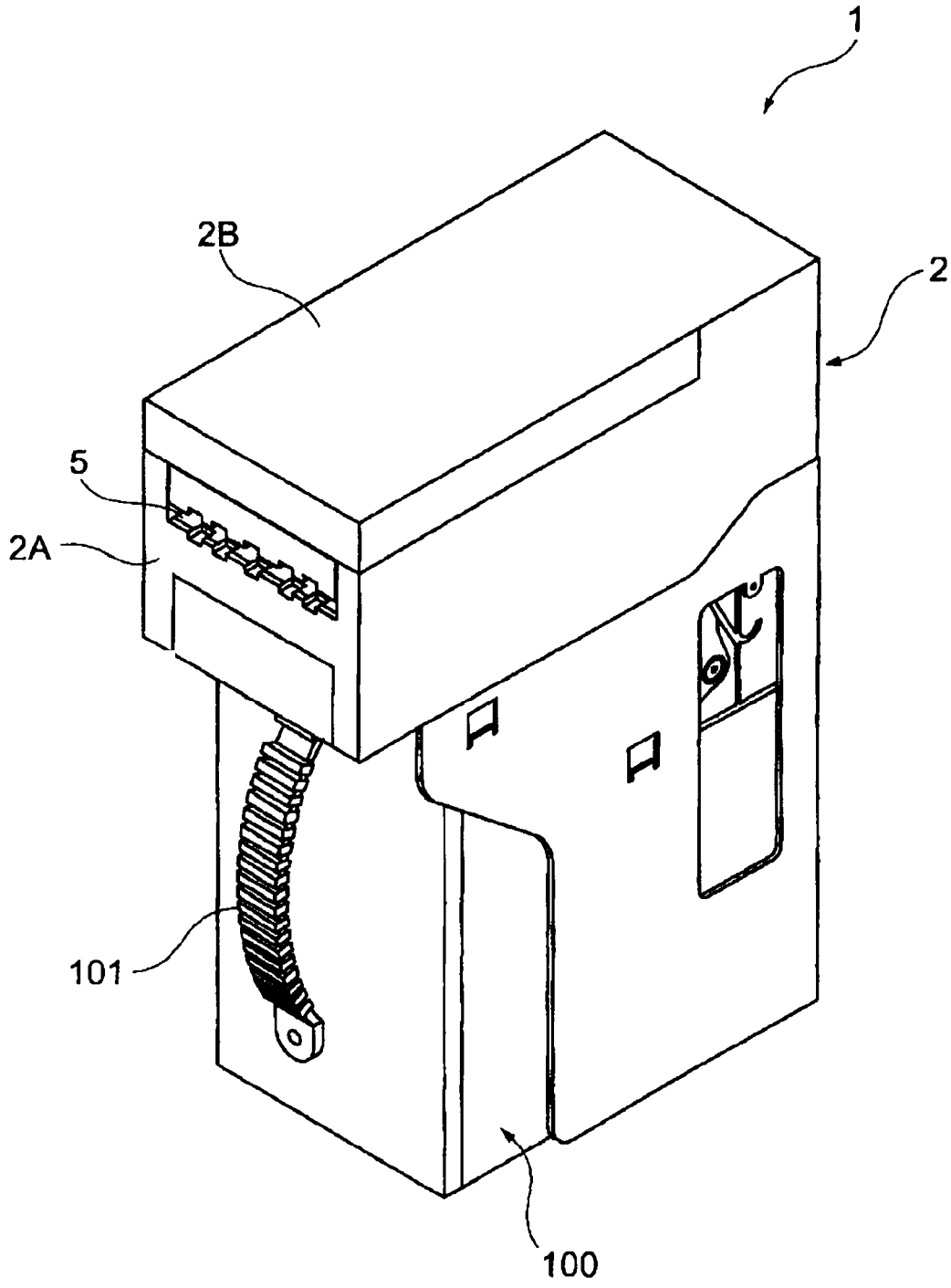
FIG. 1 is a perspective view showing an entire structure to illustrate a configuration of a bill processing apparatus of this embodiment.
Figure 2:
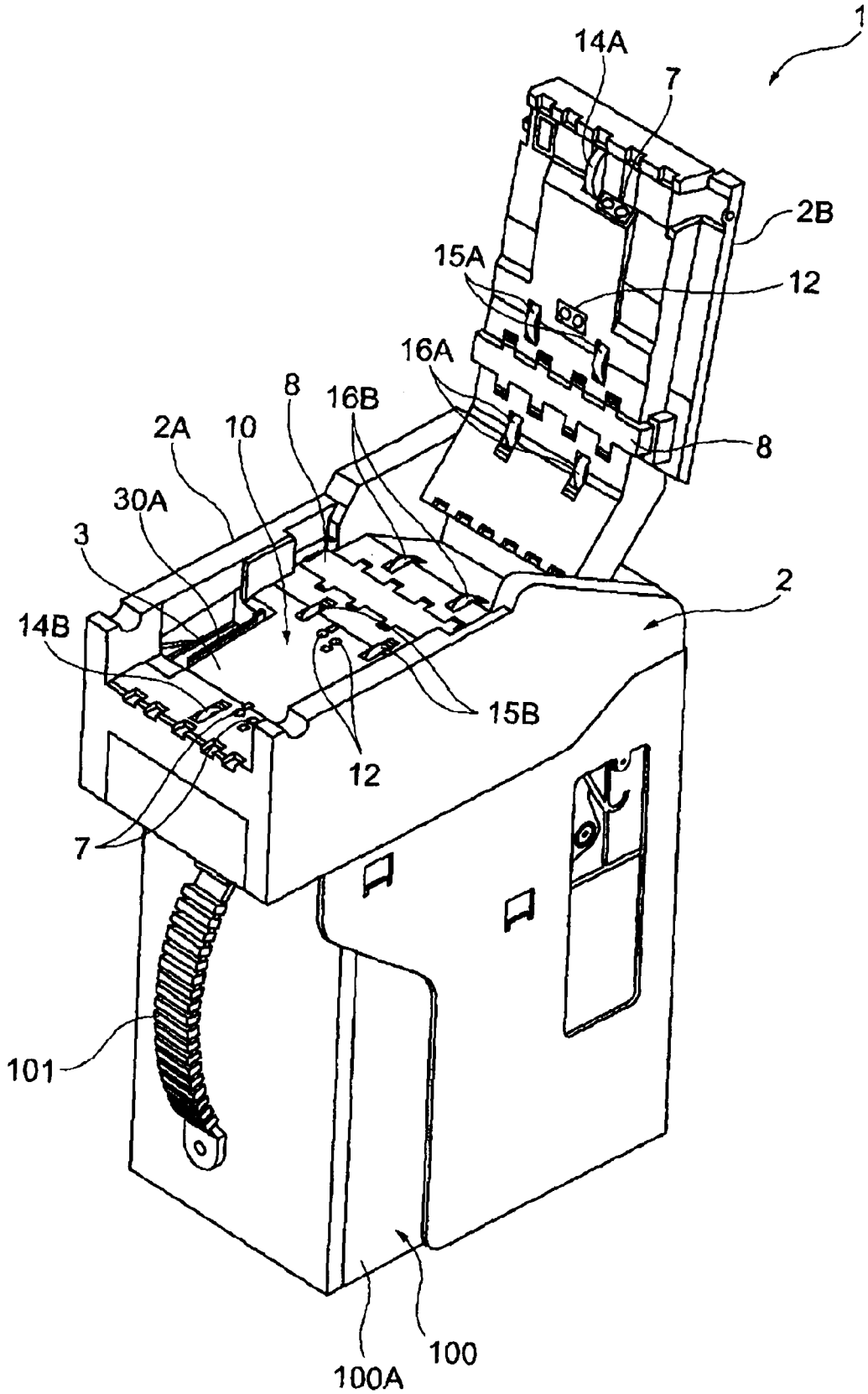
FIG. 2 is a perspective view showing the bill processing apparatus in a state where an open/close member is opened for a main body frame of an apparatus main body.
Figure 3:
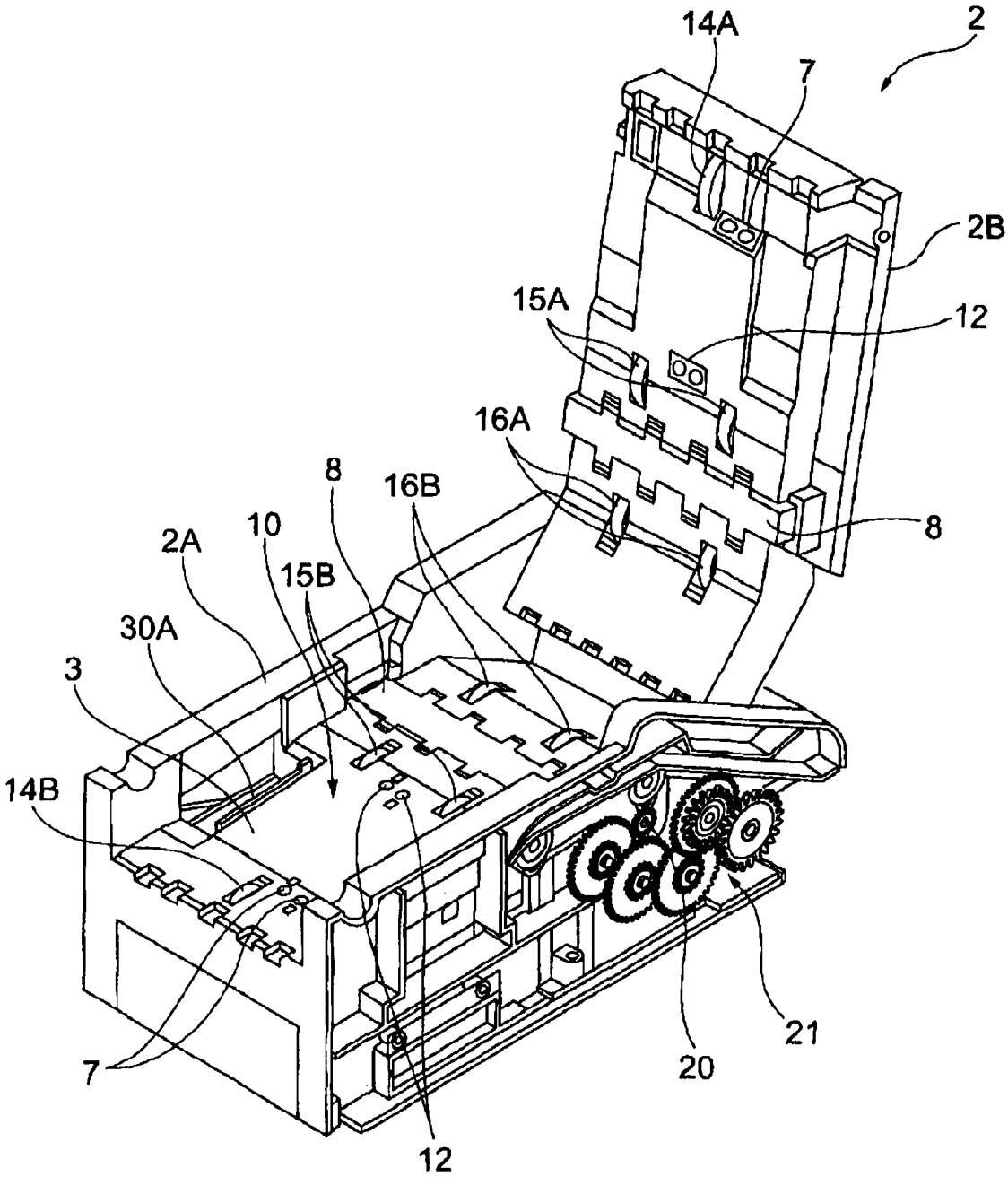
FIG. 3 is a perspective view showing a configuration of a power transmission part of the apparatus main body.
Figure 4:
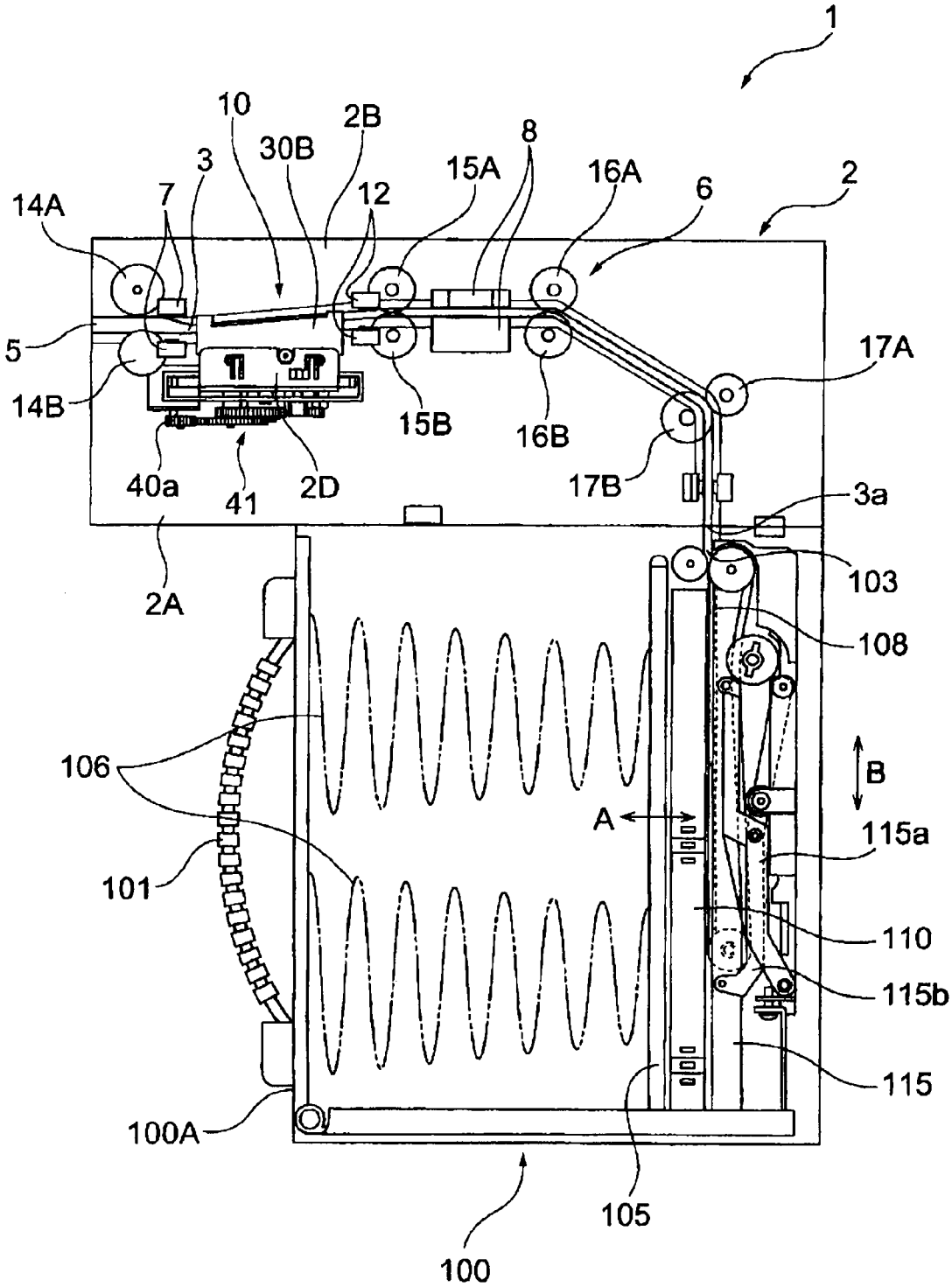
FIG. 4 is a right side view schematically showing a traveling route of a bill to be inserted from an insertion slot.
Figure 5:
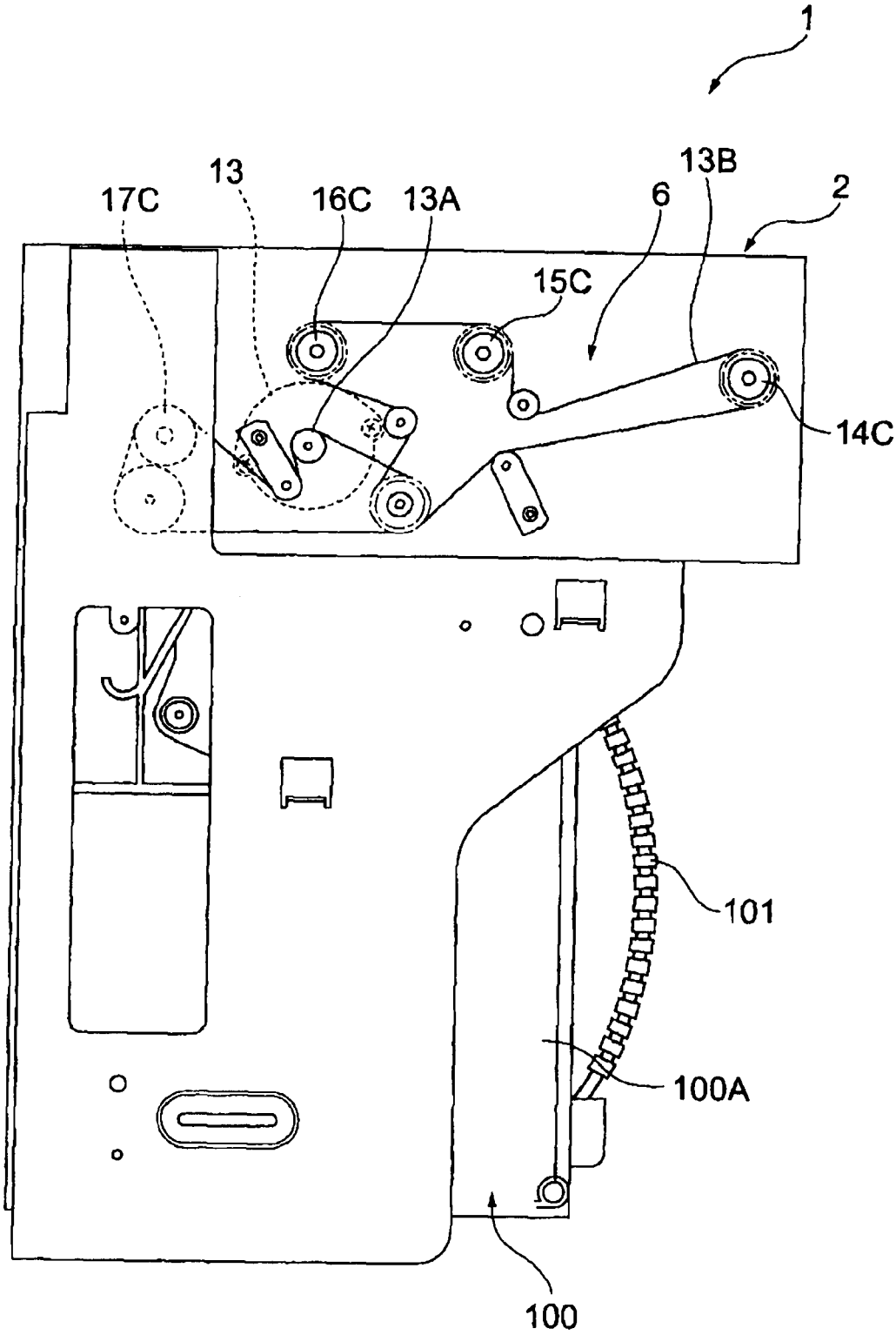
FIG. 5 is a left side view showing a schematic configuration of a driving source and a driving force transmission mechanism to drive a bill conveyance mechanism.
Figure 6:
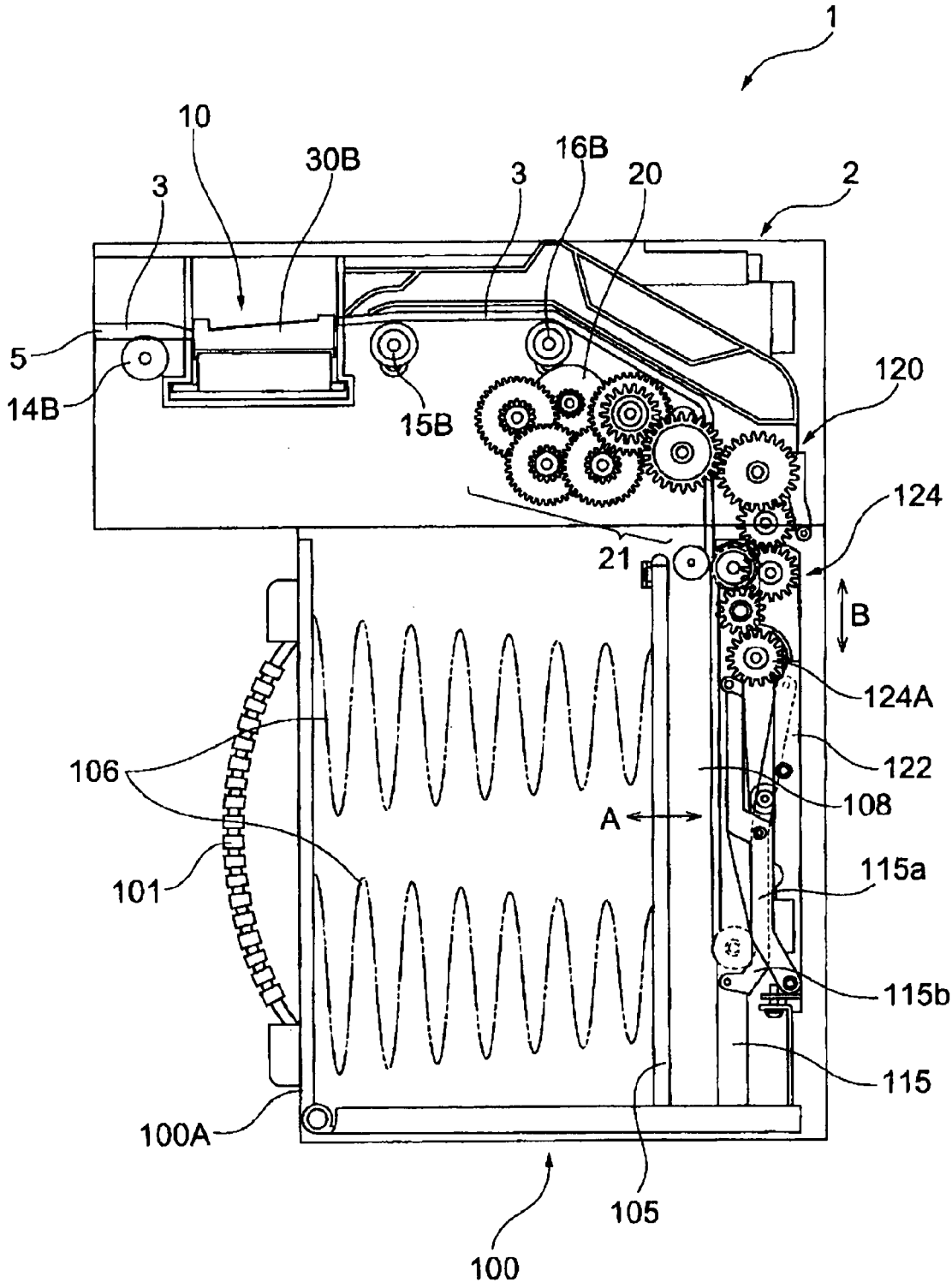
FIG. 6 is a diagram showing a schematic configuration of the driving force transmission mechanism to drive a presser plate installed in a bill stacker.

FIGS. 1 to 6 are diagrams showing a configuration of a bill processing apparatus according to the present embodiment. FIG. 1 is a perspective view showing the entire structure. FIG. 2 is a perspective view showing a state in which an open/close member is opened for a main body frame of an apparatus main body. FIG. 3 is a perspective view showing a structure of a power transmission part of the apparatus main body. FIG. 4 is a right side view schematically showing a traveling route for a bill to be inserted from an insertion slot. FIG. 5 is a left side view showing a schematic structure of a driving source and a driving force transmission mechanism to drive a bill conveyance mechanism. FIG. 6 is a diagram showing a schematic structure of a driving force transmission mechanism to drive a presser plate installed in a bill housing part.

A bill processing apparatus 1 of this embodiment is configured to be incorporable into, for example, various types of game machines such as slot machines, and the bill processing apparatus 1 includes an apparatus main body 2 and a bill housing part (e.g., bill stacker or cashbox) 100 which is provided on the apparatus main body 2, and is capable of laminating and housing a great number of bills. In this case, the bill housing part 100 may be removable from the apparatus main body 2, and for example, in a state in which an unillustrated lock mechanism is released, the bill housing part 100 can be detached from the apparatus main body 2 by pulling a handle 101 provided on the front face thereof.

As shown in FIGS. 2 and 3, the apparatus main body 2 has a main body frame 2A and an open/close member 2B configured to be opened and closed with its one end as a rotating center with respect to the main body frame 2A. Then, as shown in FIG. 4, the main body frame 2A and the open/close member 2B are configured to form a space (bill traveling route) 3 through which a bill is carried at a portion at which both face each other when the open/close member 2B is closed with respect to the main body frame 2A, and to form a bill insertion slot 5 so as to correspond to the bill traveling route 3 at the front face exposed side of both. In addition, the bill insertion slot 5 is a slit-like opening from which a short side of a bill can be inserted into the inside of the apparatus main body 2.

In the apparatus main body 2, a bill conveyance mechanism 6 that carries a bill, an insertion detecting sensor 7 that senses the bill inserted into the bill insertion slot 5, a bill reading means 8 which is installed at a downstream side of the insertion detecting sensor 7, and reads information on the bill in a carrying sate, a skew correction mechanism 10 that accurately positions and carries the bill with respect to the bill reading means 8, a movable piece passage detecting sensor 12 that senses that the bill passes through movable pieces structuring the skew correction mechanism, and a control means 200 (a control circuit substrate 200A; refer to FIG. 12) for controlling the driving of the bill conveyance mechanism 6, the bill reading means 8, and the skew correction mechanism 10 are provided along the bill traveling route 3.

Hereinafter, the respective components described above will be described in detail.

The bill traveling route 3 is extended from the bill insertion slot 5 toward the back side, and is formed to be bent so as to be inclined downward at its rear side, and to be eventually bent in the vertical direction. A discharge slot 3*a* from which the bill is discharged to the bill housing part 100 is formed in the bill traveling route 3, and the bill discharged therefrom is fed into a feed port 103 of the bill housing part 100 in the vertical direction.

The bill conveyance mechanism 6 is a mechanism capable of carrying a bill inserted from the bill insertion slot 5 along the inserting direction, and of feedback-carrying a bill in an inserted state toward the bill insertion slot 5. The bill conveyance mechanism 6 includes a motor 13 serving as a driving source installed in the apparatus main body 2, and conveyor roller pairs (14A and 14B), (15A and 15B), (16A and 16B), and (17A and 17B) which are installed at predetermined intervals along the bill carrying direction in the bill traveling route 3, and are driven to rotate by the motor 13.

The conveyor roller pairs are installed so as to be partially exposed on the bill traveling route 3, and all the pairs are rollers in which the conveyor rollers 14B, 15B, 16B, and 17B installed on the underside of the bill traveling route 3 are driven by the motor 13, and the conveyor rollers 14A, 15A, 16A, and 17A installed on the upper side are pinch-rollers driven according to these rollers. In addition, the conveyor roller pair (14A and 14B) that is first to hold a bill inserted from the bill insertion slot 5 therebetween, to carry it to the back side is, as shown in FIGS. 2 and 3, installed at one place at the center position of the bill traveling route 3, and the conveyor roller pairs (15A and 15B), (16A and 16B), and (17A and 17B) which are disposed in the order at the downstream side thereof are respectively disposed at two places at predetermined intervals along the width direction of the bill traveling route 3.

Further, the conveyor roller pair (14A and 14B) disposed in the vicinity of the bill insertion slot 5 is usually in a state in which the upper conveyor roller 14A is spaced from the lower conveyor roller 14B, and when insertion of a bill is sensed by the insertion detecting sensor 7, the upper conveyor roller 14A is driven to move toward the lower conveyor roller 14B to hold the inserted bill therebetween. In addition, the upper conveyor roller 14A is driven to control to touch and be spaced from the conveyor roller 14B by a driving source 70 (refer to a block diagram of FIG. 12). The driving source 70 may be composed of a motor, solenoid, and the like, and is installed in the open/close member 2B.

Then, when a process for positioning with respect to the bill reading means 8 by eliminating skew of an inserted bill (skew correction process) is executed by a skew correction mechanism described later, the upper conveyor roller 14A is spaced from the lower conveyor roller 14B to release the load on the bill, and when the skew correction process is completed, the upper conveyor roller 14A is driven to move toward the lower conveyor roller 14B again to hold the bill therebetween.

The conveyor rollers 14B, 15B, 16B, and 17B installed on the underside of the bill traveling route 3 are, as shown in FIG. 5, driven to rotate via the motor 13 and pulleys 14C, 15C, 16C, and 17C installed at the ends of the driving shafts of the respective conveyor rollers. That is, a driving pulley 13A is installed on the output shaft of the motor 13, and a driving belt 13B is wound around among the pulleys 14C, 15C, 16C, and 17C installed at the ends of the driving shafts of the respective conveyor rollers with the driving pulley 13A. In addition, tension pulleys are engaged in places with the driving belt 13B, which prevents it from loosening.

In accordance with the structure described above, when the motor 13 is driven to normally rotate, the conveyor rollers 14B, 15B, 16B, and 17B are driven to normally rotate in synchronization therewith to carry the bill toward the inserting direction. When the motor 13 is driven to reversely rotate, the conveyor rollers 14B, 15B, 16B, and 17B are driven to reversely rotate in synchronization therewith to carry the bill toward the bill insertion slot 5 side.

The insertion detecting sensor 7 is to generate a sensed signal when a bill inserted into the bill insertion slot 5 is sensed. In the present embodiment, the insertion detecting sensor 7 is installed between the conveyor roller pair 14A and 14B and the skew correction mechanism 10 which will be described later. The insertion detecting sensor 7 is composed of, for example, an optical sensor such as a regression reflective photo sensor. However, the insertion detecting sensor 7 may be composed of a mechanical sensor other than an optical sensor.

Further, the movable piece passage detecting sensor 12 is to generate a sensed signal when it is sensed that a front end of a bill passes through the movable pieces structuring the skew correction mechanism 10, and the movable piece passage detecting sensor 12 is installed at the upstream side of the bill reading means 8. The movable piece passage detecting sensor 12 is also composed of an optical sensor or a mechanical sensor in the same way as the aforementioned insertion detecting sensor.

In addition, the movable piece passage detecting sensor 12 generates a bill-back-end sensed signal in order to perform a movable piece closing process which will be described later when a back end position of a bill to be carried is sensed.

The bill reading means 8 reads bill information on the bill carried in a state in which the skew is eliminated by the skew correction mechanism 10, and judges validity (authenticity) thereof. In detail, for example, the bill reading means 8 may be composed of, for example, a line sensor that performs reading of the bill such that a bill to be carried is irradiated with light from both sides, and a transmitted light and a reflected light therefrom is sensed by a light receiving element. A line sensor is shown in the drawing, and an optical signal read by the line sensor is photoelectric-converted, and the signal is compared and checked with data of a legitimate bill stored in advance, which makes it possible to identify the authenticity of the bill to be carried.

The bill housing part 100 that houses bills is configured so as to be removable from the apparatus main body 2, and laminates and houses bills identified as being genuine by the bill reading means 8 sequentially.

As shown in FIGS. 4 and 6, a main body frame 100A structuring the bill housing part 100 is formed into a substantially rectangular parallelepiped shape, and a placing plate 105 on which bills to be fed via the feed port 103 are sequentially laminated, and a biasing means (biasing spring) 106 that biases the placing plate 105 toward a presser plate 115 which will be described later are provided inside the main body frame 100A.

In the main body frame 100A, a press waiting part 108 that holds a bill waiting to be dropped to wait is provided so as to be continued from the feed port 103. A pair of regulatory walls (only one of those is illustrated in FIG. 4, and this is omitted in FIG. 6) 110 is disposed so as to extend in the vertical direction on both sides of the press waiting part 108 at the placing plate side. The pair of regulatory walls 110 serves to touch both sides of an uppermost bill to stably hold the bills to be laminated when bills are sequentially laminated on the placing plate 105 and the placing plate 105 is biased by the biasing means 106.

Further, the presser plate 115 that presses bills dropped on the press waiting part 108 from the feed port 103 toward the placing plate 105 is installed in the main body frame 100A. The presser plate 115 is formed in a size to be capable of passing through a space between the pair of regulatory walls 110, and gets into the space to be driven to reciprocate between a position at which the bills are pressed against the placing plate 105 (a pressing position) and a position at which the press waiting part 108 is opened (an initial position).

As shown in FIGS. 4 and 6, the presser plate 115 is driven to reciprocate as described above via a presser plate driving mechanism 120 installed in the main body frame 100A. The presser plate driving mechanism 120 includes a pair of link members 115*a* and 115*b* whose both ends are supported pivotally by the presser plate so as to allow the presser plate 115 to reciprocate in arrow A directions, and these link members 115*a* and 115*b* are connected in an X-shaped configuration, and the respective ends opposite to one another are supported pivotally by a movable member 122 installed to be movable in a vertical direction (an arrow B direction). A rack is formed in the movable member 122, and a pinion 124A structuring the presser plate driving mechanism 120 is engaged with the rack.

In addition, as shown in FIG. 6, a housing part side gear train 124 structuring the presser plate driving mechanism 120 is connected to the pinion 124A. In this case, in the present embodiment, as shown in FIGS. 3 and 6, a driving source (motor 20) and a main body side gear train 21 sequentially engaged with the motor 20 are installed in the apparatus main body 2, and when the bill housing part 100 is mounted on the apparatus main body 2, the main body side gear train 21 is connected to the housing part side gear train 124. That is, the presser plate 115 is driven to reciprocate in the arrow A directions by the motor 20 provided in the apparatus main body 2 via the presser plate driving mechanism 120 (link members 115*a* and 115*b*, the movable member 122, and the housing part side gear train 124) and the main body side gear train 21.

Figure 7:
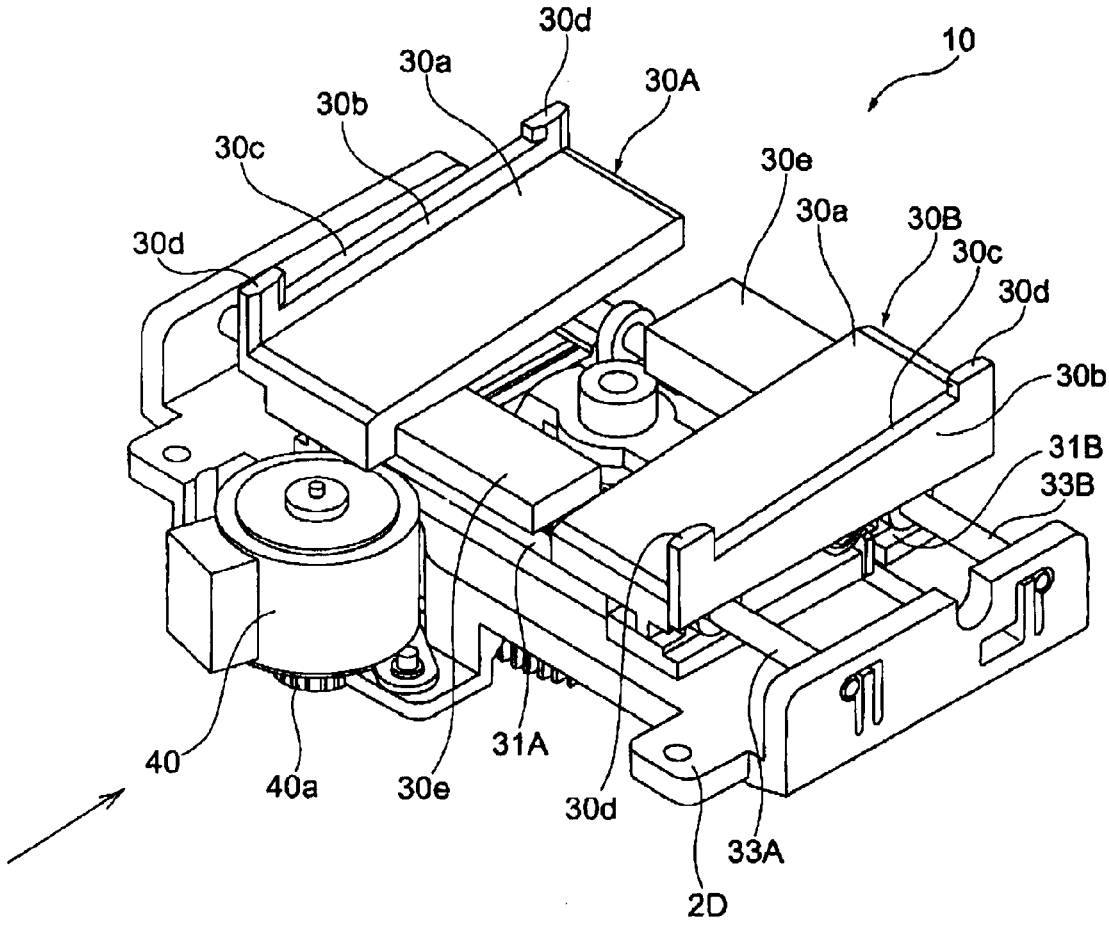
FIG. 7 is a perspective view showing an entire configuration of a skew correction mechanism.
Figure 8:
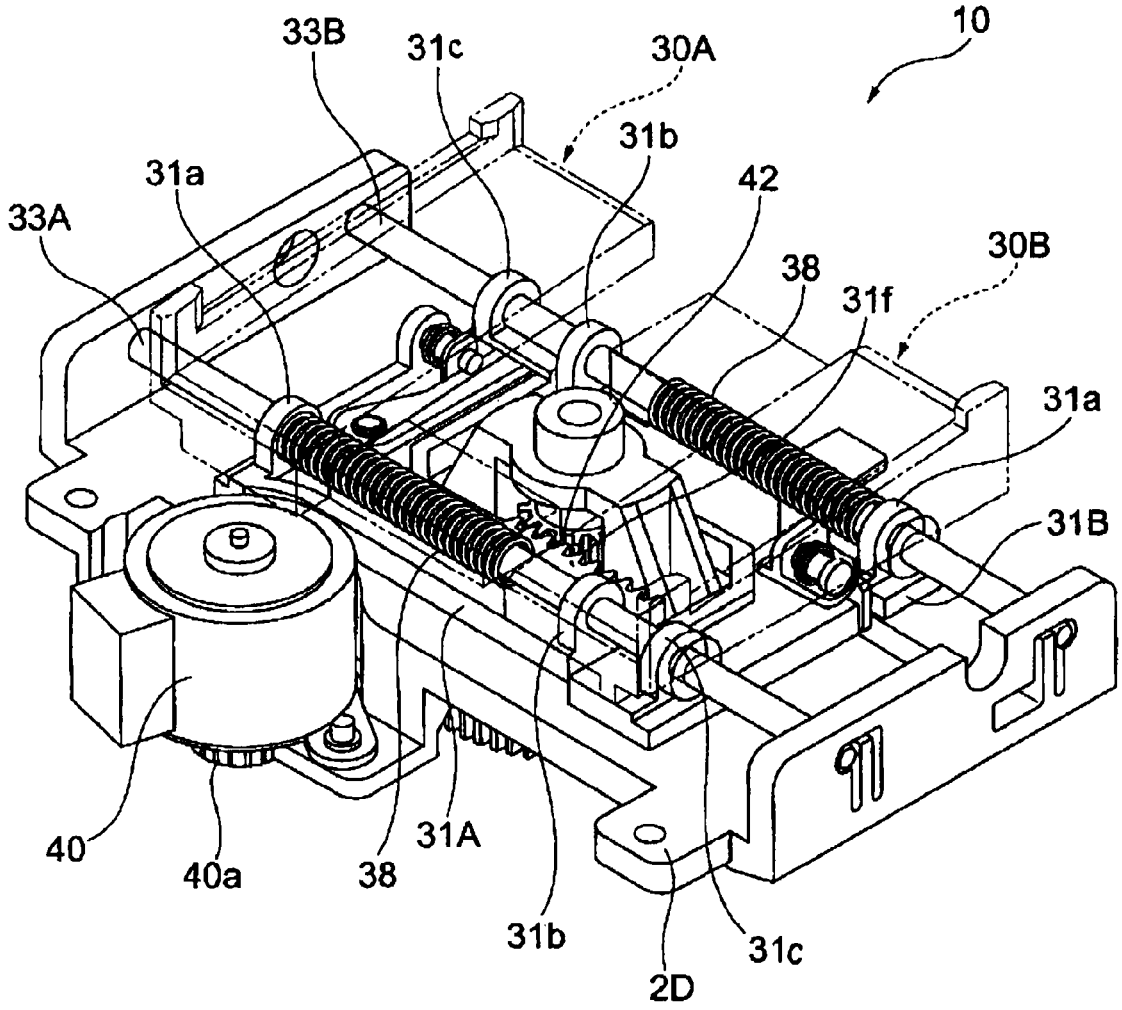
FIG. 8 is a diagram showing an arrangement of springs installed between movable pieces and base parts.
Figure 9A:
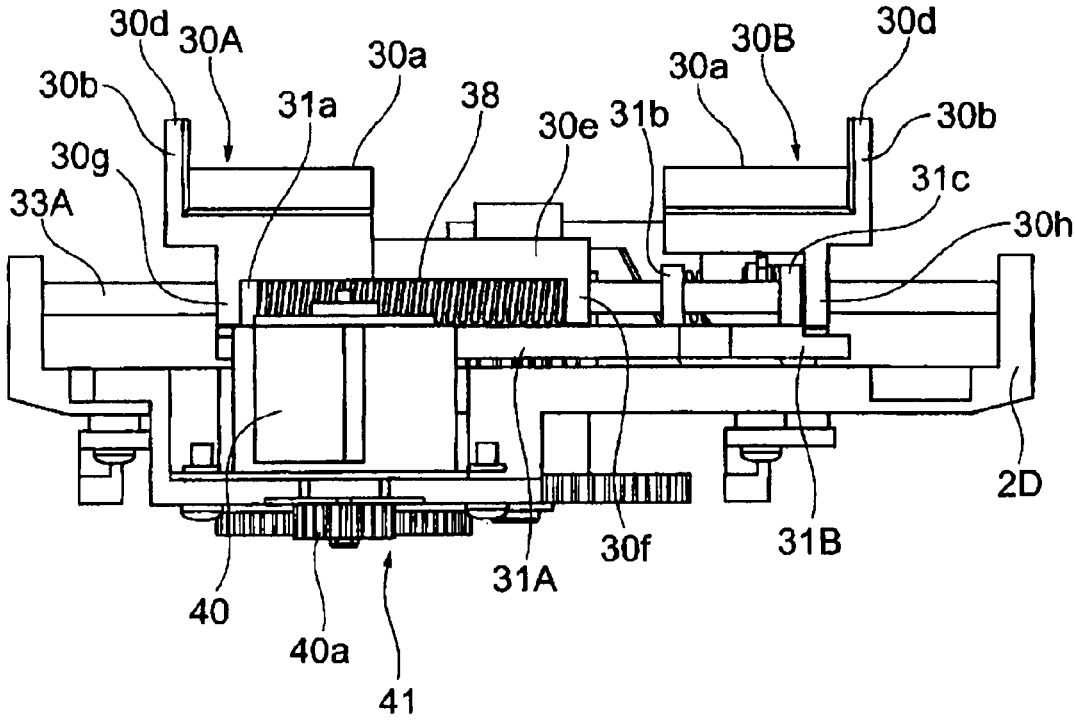
FIG. 9A is a front view of the skew correction mechanism viewed from the side of the bill insertion slot.
Figure 9B:
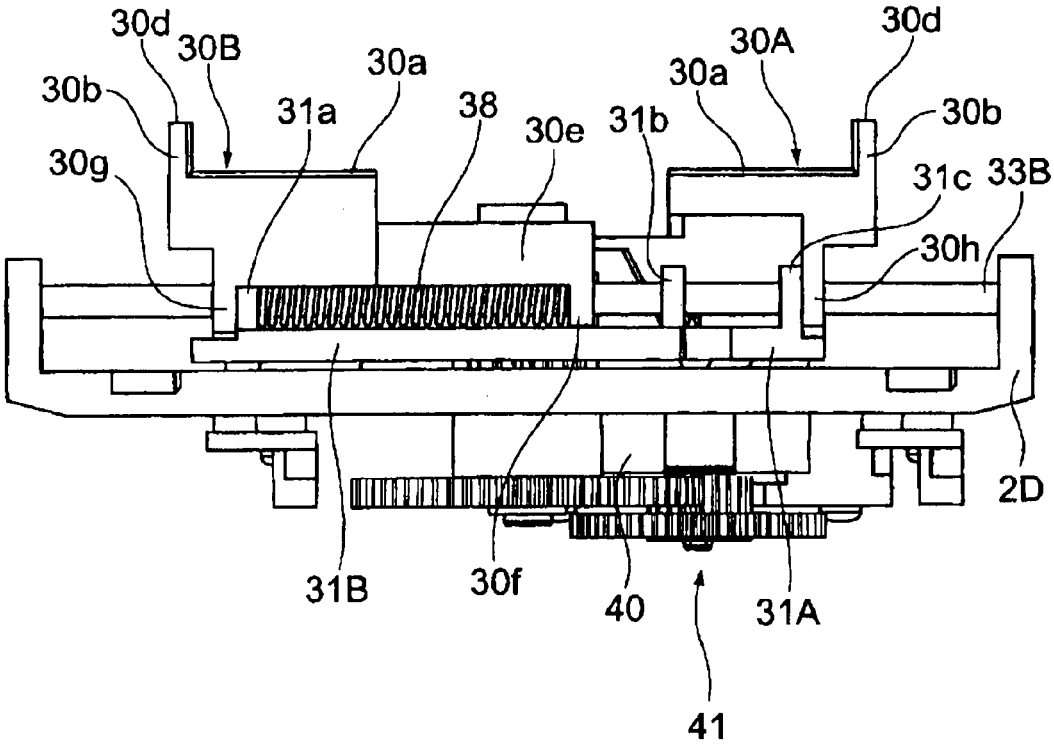
FIG. 9B is a rear view of the skew correction mechanism viewed from the opposite side.
Figure 10:
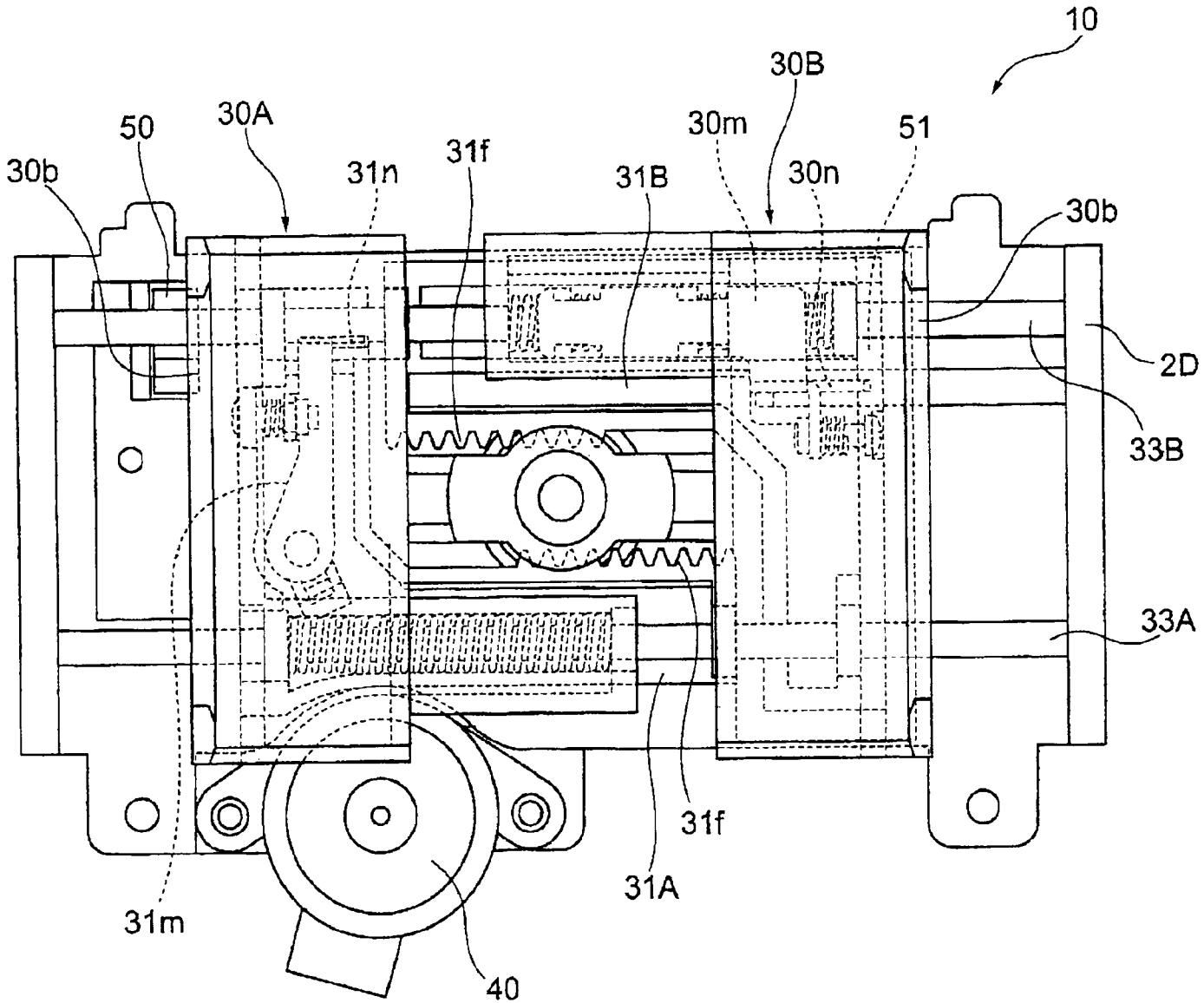
FIG. 10 is a plan view of the skew correction mechanism.
Figure 11A:
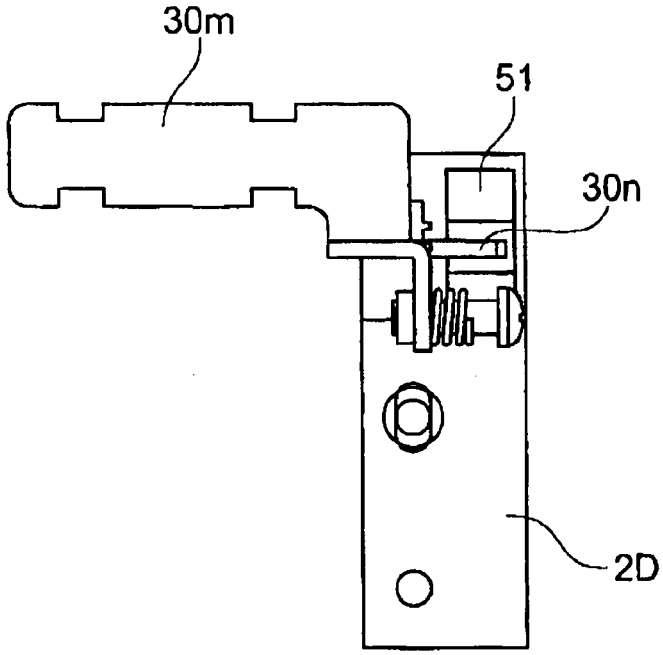
FIG. 11A is a diagram showing a configuration of a base member sensor shown in FIG. 10.
Figure 11B:
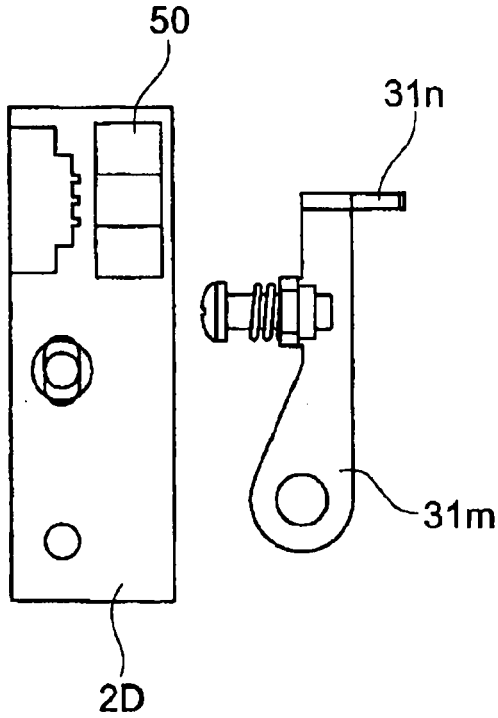
FIG. 11B is a diagram showing a configuration of a movable piece sensor shown in FIG. 10.

Next, the skew correction mechanism 10 will be described in detail with reference to FIGS. 7 to 11. In addition, among these diagrams, FIG. 7 is a perspective view showing an entire structure of the skew correction mechanism, FIG. 8 is a diagram showing a layout mode of springs installed between movable pieces and base parts, FIG. 9A is a front view of the skew correction mechanism viewed from the side of the bill insertion slot, FIG. 9B is a rear view of the skew correction mechanism viewed from the opposite side, FIG. 10 is a plan view of the skew correction mechanism, and FIGS. 11A and 11B are diagrams respectively showing structures of a portion of a base part sensor and a movable piece sensor shown in FIG. 10.

The skew correction mechanism 10 is installed on the surface portion of the bill traveling route 3 through which a bill is carried in the main body frame 2A of the apparatus main body 2. In FIG. 7, the direction shown by the arrow is the bill inserting direction, and the skew correction mechanism 10 of the present embodiment includes a pair of movable pieces 30A and 30B which are installed so as to be bilaterally-symmetric with respect to the bill traveling route, that regulate both side edges of a bill to be inserted parallel with the carrying direction. Then, these movable pieces 30A and 30B are installed on a pair of base parts 31A and 31B which come close to/are spaced from one another in a direction perpendicular to the bill carrying direction with respect to the main body frame 2A.

Hereinafter, the structures of the movable pieces 30A and 30B and the base parts 31A and 31B will be described. In addition, in the following description, because these members have a bilaterally-symmetric structure, the components at one side (the movable piece 30A and the base part 31A on the left side viewed from the inserting direction) will be mainly described. Further, components which are the same in the movable pieces 30A and 30B and the base parts 31A and 31B are denoted by the same reference numerals.

Two guide members 33A and 33B extending in a direction perpendicular to the bill carrying direction are installed at a predetermined space along the bill carrying direction to a base 2D integrated with the main body frame 2A. Then, the base part 31A is installed so as to be axially movable with respect to the guide member 33A, and the base part 31B is installed so as to be axially movable with respect to the guide member 33B.

In this case, the base part 31A is formed so as to extend along the guide member 33A, and is installed so as to be axially movable with respect to the guide member 33A due to the guide member 33A being inserted into through-holes formed in a pair of flanges 31*a* and 31*b*. Further, the base part 31A is formed to be bent toward the guide member 33B at a right angle in order to be able to stably move at the time of moving along the guide member 33A, and is held to the guide member 33B as well. In FIG. 9B, a flange of a portion at which the base part 31A is held to the guide member 33B is shown by reference numeral 31*c*. In addition, the base part 31B is also formed to extend along the guide member 33B in the same structure, and is installed so as to be axially movable with respect to the guide member 33B due to the guide member 33B being inserted into through-holes formed in the pair of flanges 31*a* and 31*b*, and the base part 31B is formed to be bent toward the guide member 33A at a right angle, and is held to the guide member 33A. In the same way, in FIG. 9A, a flange of a portion at which the base part 31B is held to the guide member 33A is shown by reference numeral 31*c*.

A flat surface 30*a* facing the rear surface of the bill traveling route 3 and a plate-like regulatory wall 30*b* which is formed at a side end of the flat surface 30*a*, that contacts a side edge of a bill to be carried, are formed at the movable piece 30A. That is, the movable piece 30A is installed such that the regulatory wall 30*b* portion protrudes upward from the bill traveling route 3. Further, protrusions 30*d* protruding upward from its upper rims 30*c* of the regulatory wall are formed at the front end position and the back end position in the bill carrying direction.

The movable piece 30A having the shape as described above is supported on the base part 31A in a state in which a spring 38 is interposed therebetween so as to be relatively movable with respect to the base part 31A. In detail, an extended part 30*e* extending toward the central side in the axial direction of the guide member 33A is formed to the movable piece 30A, and a flange 30*f* including a through hole through which the guide member 33A is inserted is formed at an end of the extended part 30*e*. Then, the spring 38 that biases the movable piece 30A toward the center of the bill traveling route is interposed between the flange 30*f* and the flange 31*a* formed on the base part 31A.

Further, a flange 30*g* including a through hole through which the guide member 33A is inserted is formed at the outer side along the axial direction of the movable piece 30A. In this case, because the movable piece 30A comes to be biased toward the center of the bill traveling route by the spring 38, the flange 30*g* of the movable piece 30A comes to touch the flange 31*a* formed on the base part 31A as shown in FIG. 9A.

Moreover, a flange 30*h* including a through hole through which the guide member 33B is inserted is formed to the movable piece 30A so as to be supported with respect to the guide member 33B. As shown in FIG. 9B, the flange 30*h* is installed so as to be located at the outer side along the axial direction of the flange 31*c* formed on the base part 31A, and as described above, because the movable piece 30A comes to be biased toward the center of the bill traveling route by the spring 38, the flange 30*h* of the movable piece 30A comes to touch the flange 31*c* formed on the base part 31A.

Then, the base parts 31A and 31B supporting the movable pieces 30A and 30B relatively movable as described above are driven so as to come close to one another toward the center of the bill traveling route and be spaced from one another from the center by a driving source 40 installed on the base 2D integrated with the main body frame 2A. In the present embodiment, the driving source 40 is composed of a motor, and the base parts 31A and 31B are driven via a power transmission mechanism (a gear train 41 sequentially engaged with a drive gear 40*a* installed on the output shaft of the motor). In detail, a pinion 42 which is the end gear of the gear train 41 is disposed so as to be located at an intermediate position between the guide members 33A and 33B, and racks 31*f* formed on the base parts 31A and 31B so as to face one another are engaged with the pinion 42. That is, when the motor 40 drives to normally rotate, the base parts 31A and 31B are moved toward the directions in which both come close to one another via the pinion 42 and the racks 31*f*, and when the motor (driving source) 40 drives to reversely rotate, the base parts 31A and 31B are moved toward the directions in which both are spaced from one another via the pinion 42 and the racks 31*f*.

In addition, at the time of moving the base parts 31A and 31B, a structure using a driving source such as a solenoid or a linear motor other than the above-described one, may be employed.

As described above, when the base part 31A is driven so as to move toward the center of the bill traveling route by the motor 40, the movable piece 30A is moved toward the center of the bill traveling route due to biasing force of the spring 38 interposed between the both. Then, when the base part 31A moves toward the center of the bill traveling route, the regulatory wall 30*b* of the movable piece 30A touches a side edge of a bill, and load by reactive force of the bill is applied to the motor 40 thereby. In this case, the base part 31A is further movable toward the center of the bill traveling route with respect to the movable piece 30A against the biasing force of the spring 38.

In detail, the biasing force of the spring 38 is preferably set to be less than the reactive force of a bill to be carried between the movable pieces 30A and 30B, and an extent that the bill can be moved toward the center of the bill traveling route is preferable. That is, as will be described later, at the time of eliminating skew of a bill, in a state in which the bill is located between the movable pieces 30A and 30B, the base parts 31A and 31B are driven so as to come close to one another. At this time, because the movable pieces 30A and 30B touch the side edges of the bill, the bill is deflected so as to curve, thereby, its reactive force is applied to the movable pieces 30A and 30B. Provided that the biasing force of the spring 38 is set in advance as described above, the possibility that a bill is bent by the movable pieces 30A and 30B is reduced, and moreover, the bill can be moved toward the center (moved so as to be positioned in the center).

Further, as shown in FIGS. 10 and 11, a base part detecting sensor 50 that senses positions of the base parts 31A and 31B, and a movable piece detecting sensor 51 that senses positions of the movable pieces 30A and 30B are installed in the skew correction mechanism 10. In this case, as described above, because the base parts and the movable pieces have a structure in which both are moved symmetrically, the base part detecting sensor 50 senses the base part 31A on the left side, and the movable piece detecting sensor 51 senses the movable piece 30B on the right side.

The base part detecting sensor 50 is installed outside the bill traveling route of the base 2D, and is formed as an optical sensor in which a light emitting part and a light receiving part face one another. A fixation piece 31*m* is screwed shut to the base part 31A, and when a sensor passage part 31*n* integrated with the fixation piece gets into a detecting part of the base part detecting sensor 50 by a movement of the base part 31A in the spacing direction, a predetermined position of the base part 31A is sensed. In this case, the base part detecting sensor 50 senses a position at which the base part 31A moves away from the center of the bill traveling route at a maximum (a position at which the base part 31A moves to the maximum width; a predetermined position).

The movable piece detecting sensor 51 is installed at an intermediate side of the bill traveling route in the base 2D, and is formed as an optical sensor in which a light emitting part and a light receiving part face one another. A fixation piece 30*m* is screwed shut to the movable piece 30B, and when a sensor passage part 30*n* integrated with the fixation piece gets into a detecting part of the movable piece detecting sensor 51 by a movement of the base part 31B to the center of the bill traveling route, and moves away therefrom, a predetermined position of the movable piece 30B is sensed. In this case, the movable piece detecting sensor 51 senses a position at which the movable piece 30B comes close to the center of the bill traveling route at a maximum (a position at which the movable piece 30B moves to have the minimum width; a predetermined position). Further, the movable piece detecting sensor 51 senses a movement of the movable piece 30B after moving the movable piece 30B toward the center of the bill traveling route, i.e., the aforementioned predetermined position.

That is, as will be described later, the pair of movable pieces has a function that the movable pieces are closed at the predetermined positions to narrow the bill traveling route, that prevents a fraudulent activity such as drawing out a bill, and in actuality, when the pair of movable pieces moves so as to open by carrying out an action of drawing out a bill, it is possible to sense the action to detect the fraudulent activity.

Figure 12:
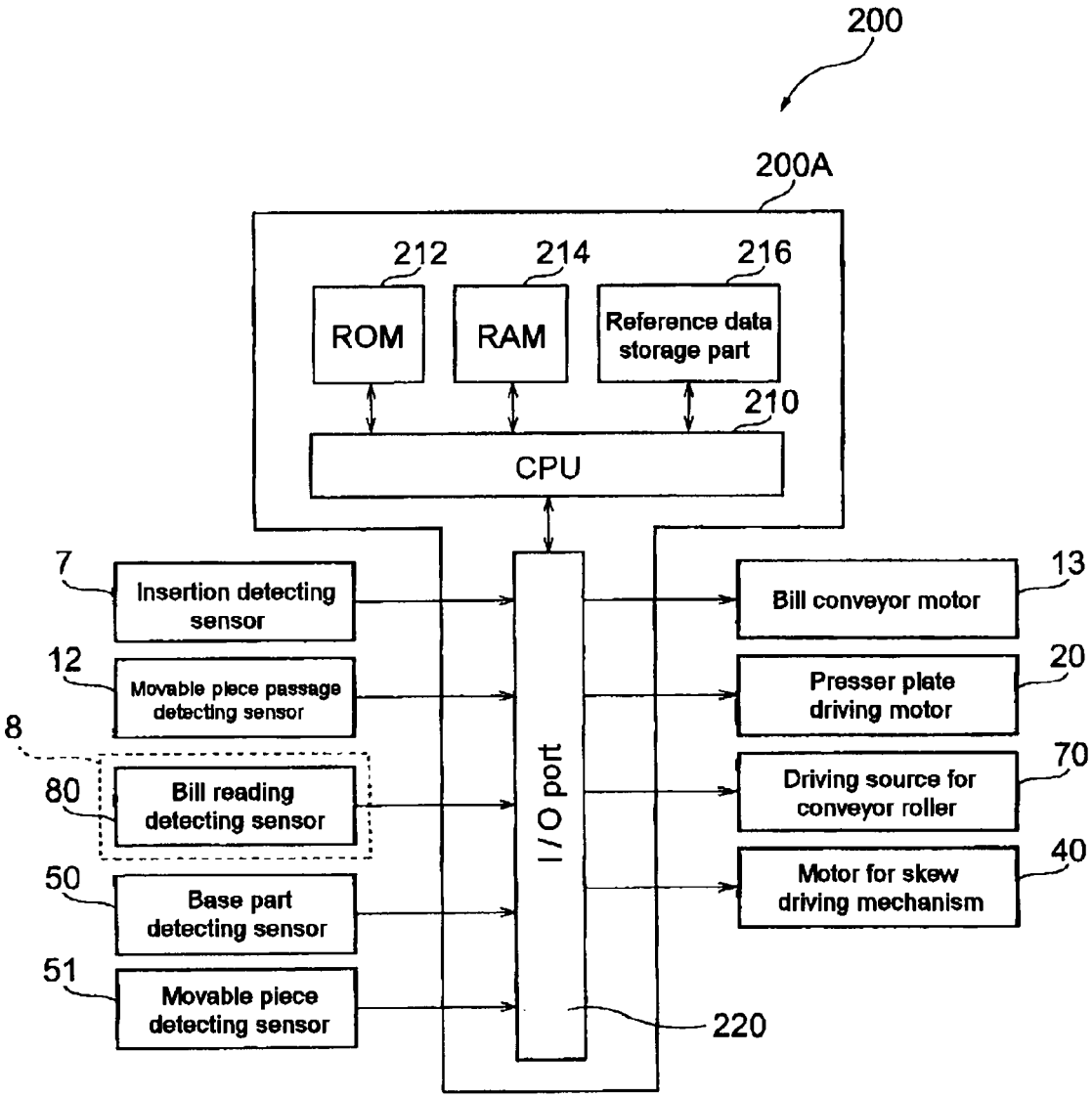
FIG. 12 is a diagram showing a configuration of a control means for controlling drives of a bill conveyance mechanism, a bill reading means, and the skew correction mechanism.
Figure 13:
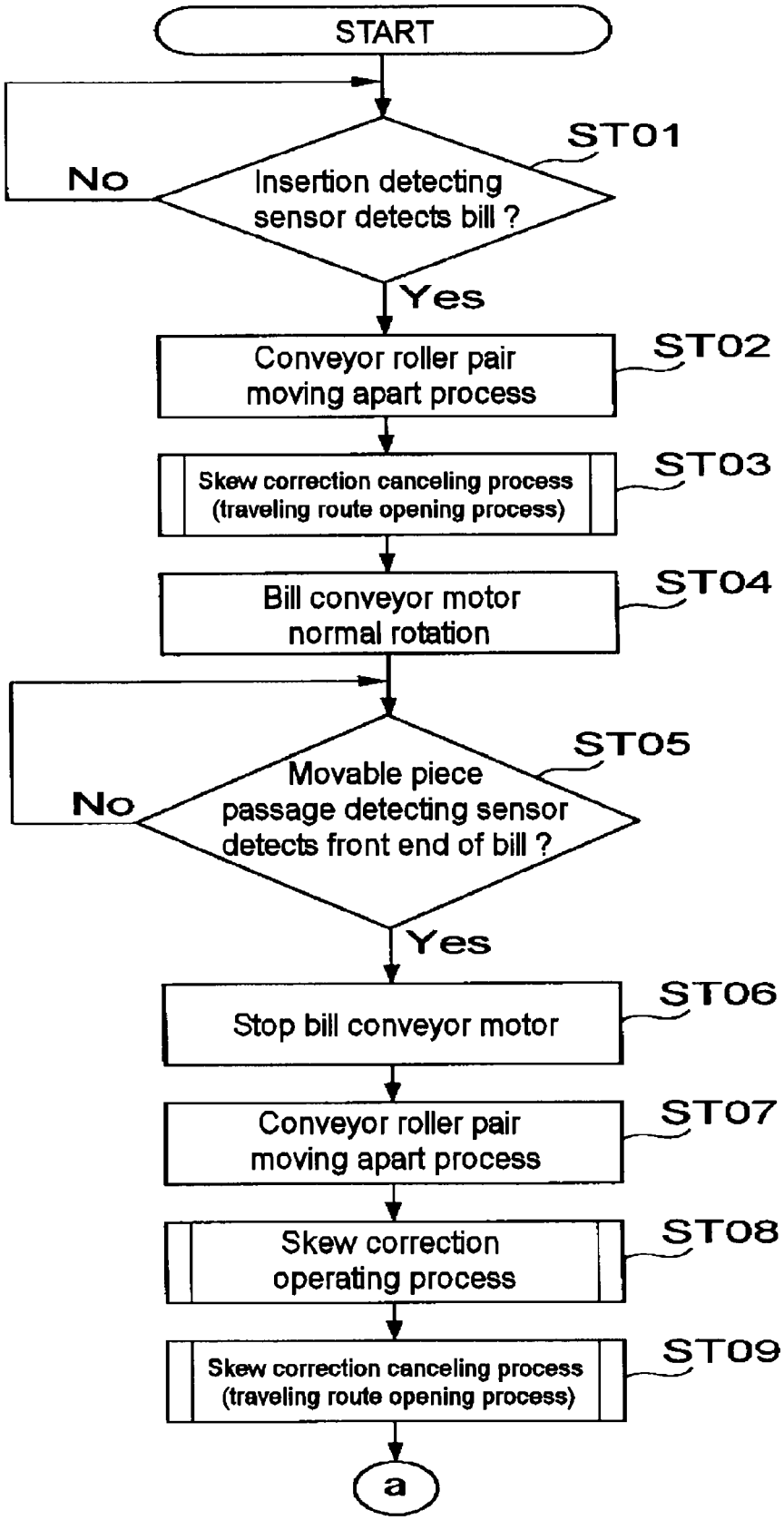
FIG. 13 shows a flowchart (part one) illustrating processing operations for processing a bill in a bill processing apparatus of this embodiment.

Next, the control means that controls the driving of the bill conveyance mechanism 6, the bill reading means 8, and the skew correction mechanism 10 will be described with reference to FIG. 12.

The control means 200 includes a control circuit substrate 200A that controls the operations of the respective drive units described above, and a CPU (Central Processing Unit) 210 structuring a bill identification means, a ROM (Read Only Memory) 212, a RAM (Random Access Memory) 214, and a reference data storage part 216 are mounted on the control circuit substrate.

In the ROM 212, various types of programs such as operation programs for the respective drive units such as the motor 13 that drives the above-described bill conveyance mechanism, the motor 20 that drives the presser plate, the driving source 70 that drives the conveyor roller 14A come close to/is spaced from the conveyor roller 14B, the motor 40 to drive the base parts in the skew driving mechanism 10, an authenticity judgment program for bills read by the bill reading means 8, and permanent data are stored. The CPU 210 generates control signals according to the programs stored in the ROM 212, and carries out input and output of the signals with respect to the respective drive units via an I/O port 220, to control the driving of the respective drive units.

Further, sensed signals from the insertion detecting sensor 7, the movable piece passage detecting sensor 12, the base part detecting sensor 50, and the movable piece detecting sensor 51 are input into the CPU 210 via the I/O port 220, and the driving of the respective drive units is controlled on the basis of these sensed signals.

Further, data and programs used for operating the CPU 210 are stored in the RAM 214, and reference data used for performing a bill authenticity judgment, for example, various types of data acquired from all the printing areas in a legitimate bill (such as data on contrasting density and data on a transmitted light or a reflected light when a bill is irradiated with infrared rays) are stored as reference data in the reference data storage part 216. In addition, the reference data are stored in the dedicated reference data storage part 216. However, the data may be stored in the ROM 212.

Then, a bill reading detection sensor (for example, a line sensor) 80 structuring the above-described bill reading means 8 is connected to the CPU 210 via the I/O port 220, and bill reading data read by the bill reading detection sensor 80 are compared with the reference data stored in the reference data storage part 216, which allows a bill authenticity judgment process to be executed.

In addition, the control means 200 that controls the operation of the bill processing apparatus is mounted on the one control circuit substrate 200A. However, the control means 200 may be disposed in a dispersive manner on separate control circuit substrates depending on its functions.

Next, the bill processing operation in the bill processing apparatus 1 executed by the control means 200 will be described according to the flowcharts of FIGS. 13 to 18.

When an operator inserts a bill into the bill insertion slot 5, the conveyor roller pair (14A and 14B) installed in the vicinity of the bill insertion slot is in a state in which the rollers are spaced from one another as in an initial state (refer to ST15 and ST55 which will be described later). That is, because of a structure in which an operator does not feed a bill into a nip part of the conveyor roller pair (14A and 14B), it is possible for the operator to easily insert even a bill with wrinkles into the bill insertion slot 5. Then, when an insertion of the bill is sensed by the insertion detecting sensor 7 (ST01), the above-described driving source 70 is driven to move the upper conveyor roller 14A to touch the lower conveyor roller 14B. In accordance therewith, the inserted bill is held between the conveyor roller pair (14A and 14B) (ST02).

Next, the skew correction mechanism 10 executes a skew correction canceling process, which may also be referred to as a traveling route opening process (ST03). This skew correction canceling process is executed following the procedure shown in the flowchart of FIG. 16. That is, in this skew correction canceling process, first, the motor 40 is driven to reversely rotate to move the pair of base parts 31A and 31B toward the directions in which both are spaced from one another (ST100). Next, when it is sensed that the base parts 31A and 31B have moved to the predetermined positions (maximum width positions) by the base part detecting sensor 50 (ST101), the driving of the motor 40 reversely rotating is stopped (ST102). By this skew correction canceling process, the pair of movable pieces 30A and 30B is moved to the outer sides of the bill traveling route with the base part, to be in a state in which it is possible for the bill to enter between the pair of movable pieces 30A and 30B. In addition, at the previous step of ST03, the bill traveling route 3 comes to be closed by a traveling route closing process (ST14, ST54) which will be described later. In this way, provided that the bill traveling route 3 is closed in advance of an insertion of the bill, it is possible to prevent an element such as a line sensor from being broken by, for example, inserting a plate-like member from the bill insertion slot for illicit purposes or the like.

In this state, the bill conveyor motor 13 is driven to normally rotate (ST04). The bill is carried into the apparatus by the conveyor roller pair (14A and 14B), and when the movable piece passage detecting sensor 12 installed at the downstream side from the skew correction mechanism 10 senses the front end of the bill, the bill conveyor motor 13 is stopped (ST05 and ST06). At this time, the bill is located between the pair of movable pieces 30A and 30B being spaced from one another to the maximum width.

Next, the above-described driving source 70 is driven to allow the conveyor roller pair (14A and 14B) coming to hold the bill therebetween to be spaced from one another (ST07). At this time, no load is applied to the bill.

Figure 17:
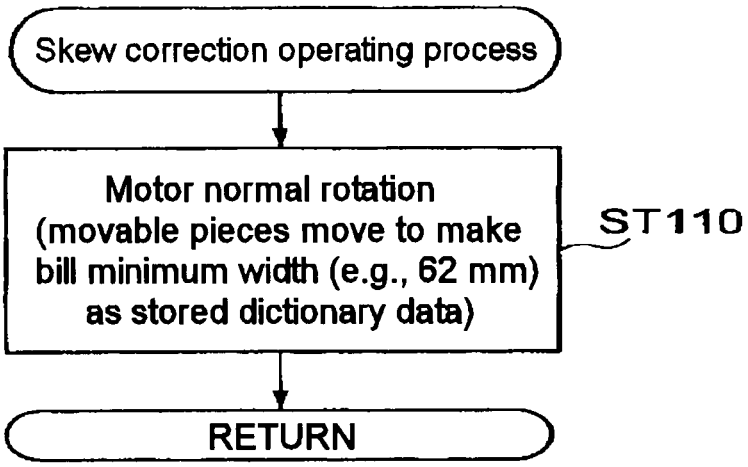
FIG. 17 shows a flowchart illustrating processing operations of a skew correction process.
Figure 19:
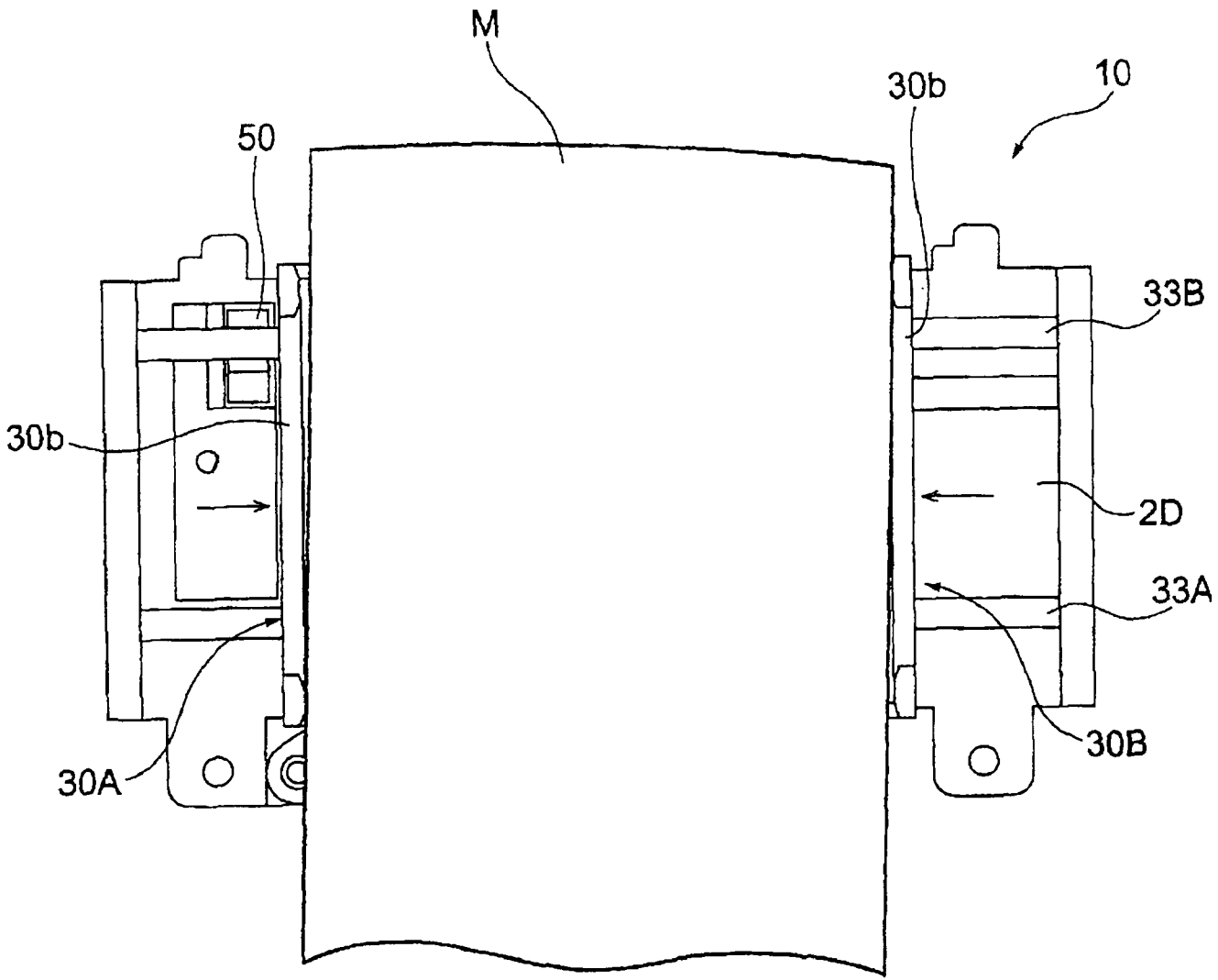
FIG. 19 is a plan view of the skew correction mechanism to show a state where a pair of movable pieces touching both side edges of a bill.

Then, a skew correction operating process is executed in this state (ST08). In this skew correction operating process, as shown in the flowchart of FIG. 17, the motor 40 is driven to normally rotate to move the pair of base parts 31A and 31B toward the directions in which both come close to one another (ST110). The movement of the base parts 31A and 31B is continued until the movable pieces 30A and 30B supported thereto move so as to have a minimum width (example; width 62 mm) of a bill registered with the reference data storage part in the control means. FIG. 19 shows a state in which the pair of movable pieces 30A and 30B move in the arrow direction due to the movement of the pair of base parts 31A and 31B toward the directions in which both come close to one another, to touch both side edges of a bill M.

Figure 20:
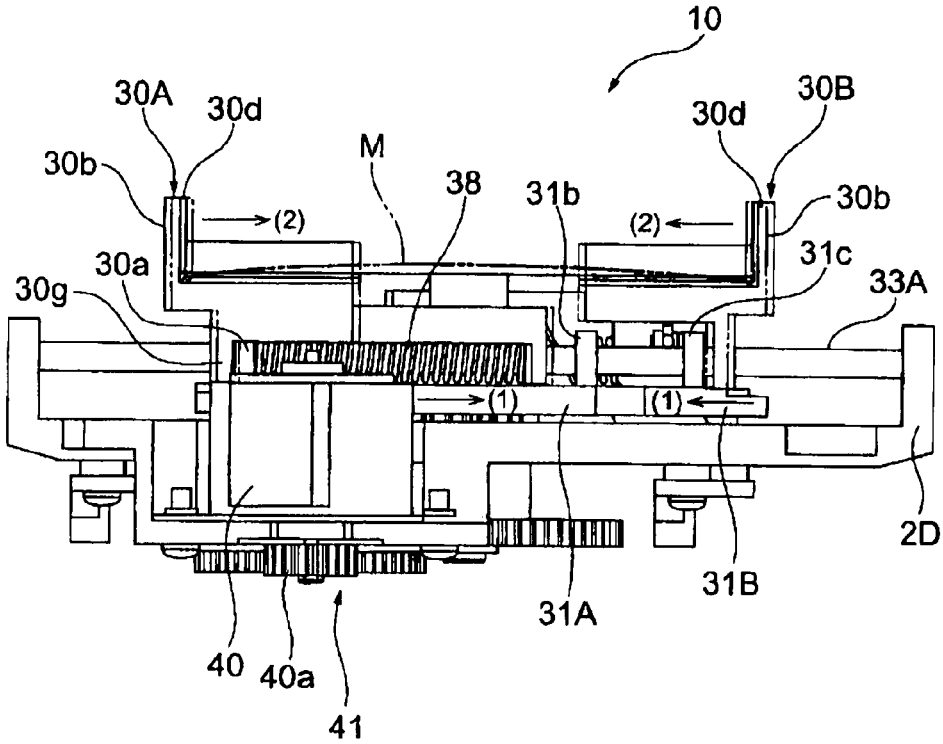
FIG. 20 is a front view of the skew correction mechanism viewed from the side of the bill insertion slot to illustrate a state where the skew is to be eliminated.

The skew correction process for the bill at this time will be described with reference to FIGS. 19 and 20.

Before the skew correction process is executed, the bill is located between the movable pieces 30A and 30B separated toward the right and left. In this state, by driving to normally rotate the above-described motor 40, the pair of base parts 31A and 31B move toward the directions in which both come close to one another (directions of arrows (1)). At this time, the pair of movable pieces 30A and 30B are integrally moved toward the center of the bill traveling route (directions of arrows (2)) due to the biasing force of the spring 38 interposed between the base parts 31A and 31B. Then, the regulatory walls 30*b* of the movable pieces 30A and 30B respectively hit (or touch) the side edges of the bill by the movement of the base parts 31A and 31B. In accordance therewith, load due to the reactive force of the bill is applied to the motor 40. However, the base parts 31A and 31B further move toward the center of the bill traveling route (directions of arrows (1)) with respect to the movable pieces 30A and 30B against the biasing force of the spring 38.

At this time, the bill is moved so as to be positioned in the center by the movable pieces 30A and 30B touching its both sides, and its skew is corrected, which positions the bill at the accurate center position. As described above, because the movement of the pair of base parts 31A and 31B is continued until the pair of movable pieces 30A and 30B are moved to have the minimum width of a bill registered with the reference data storage part in the control means, as shown by a dotted line M of FIG. 20, although there is a possibility that the bill is curved so as to curl up in its center region, the skew thereof is corrected by the pair of movable pieces and the bill is positioned accurately in the center position.

In addition, as described above, provided that the biasing force of the spring 38 is set to be less than the reactive force of the bill to be carried between the movable pieces 30A and 30B (reactive force generated when the bill is curved due to the pair of movable pieces touching the side edges of the bill), and an extent that the bill can be moved toward the center of the bill traveling route, the possibility that the bill is bent by the movable pieces 30A and 30B is reduced, and the bill can be moved toward the center (moved so as to be positioned in the center). That is, the extent that the bill is curved as described above is reduced, and the possibility that the bill is bent or the ends of the bill are damaged is reduced. Since the mechanism is not configured to make the driving motor for the skew correction lose synchronization, the load to the motor is reduced, thereby causing less possibility of breakdown.

Further, in the above-described structure, the contacting areas of the bill with respect to the movable pieces 30A and 30B are inside face portions of the plate-like regulatory walls 30*b*. In this way, the contacts of the movable pieces 30A and 30B with respect to the side edges of the bill are the plate-like regulatory wall portions, and additionally, because protrusions contacting the surfaces of both sides of the bill are not formed on the upper rims 30*c*, it is possible to effectively prevent damage to the bill.

In particular, in the present embodiment, because the protrusions 30*d* protruding upward from the upper rims 30*c* of the regulatory walls are provided at the front end position and the back end position of the regulatory walls 30*b*, when a skew correction process is executed, there are no cases in which the bill runs upon the regulatory walls 30*b* of the movable pieces 30A and 30B, which makes it possible to reliably align the bill on the center of the bill traveling route.

When the skew correction operating process as described above is completed, next, a skew correction canceling process is executed (ST09). As shown in the flowchart shown in FIG. 16, this process is executed such that the motor 40 is driven to reversely rotate to move the pair of base parts 31A and 31B toward the directions in which both are spaced from one another to the maximum width positions (ST100 to ST102).

Next, the driving source 70 is driven to move the upper conveyor roller 14A to touch the lower conveyor roller 14B, and the bill is held by the conveyor roller pair (14A and 14B) therebetween (ST10). Thereafter, the bill conveyor motor 13 is driven to normally rotate to carry the bill toward the inside of the apparatus, and when the bill passes through the bill reading means 8, a bill reading process is executed (ST11 and ST12).

Figure 18:
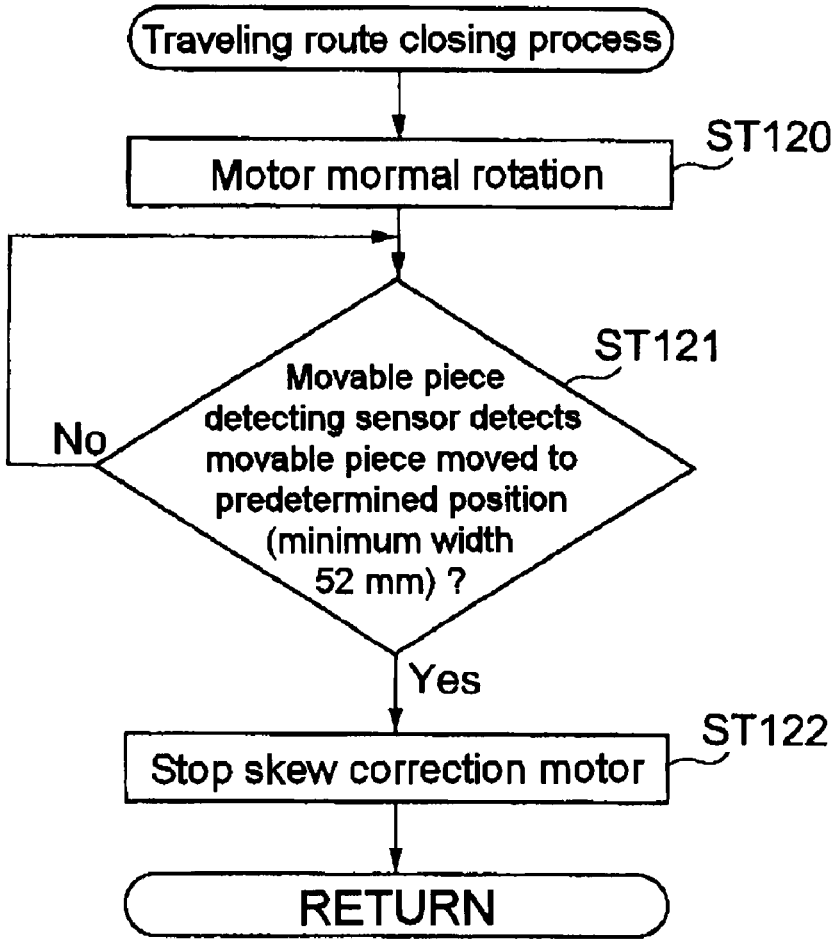
FIG. 18 shows a flowchart illustrating processing operations of a traveling route closing process.

Then, when the bill to be carried passes through the bill reading means 8, and the back end of the bill is sensed by the movable piece detecting sensor 12 (ST13), a process for closing the bill traveling route 3 is executed (ST14). In this process, first, as shown in the flowchart of FIG. 18, after the back end of the bill is sensed by the movable piece detecting sensor 12, the above-described motor 40 is driven to normally rotate to move the pair of base parts 31A and 31B toward the directions in which both come close to one another (ST120). Next, when it is sensed by the movable piece detecting sensor 51 that the movable pieces 30A and 30B move to the predetermined positions (minimum width positions) (ST121), the driving to normally rotate the motor 40 is stopped (ST122).

Here, the bill traveling route closing process (ST14) may not be executed, but it is more preferable to conduct the process due to reasons to be described later.

Figure 21:
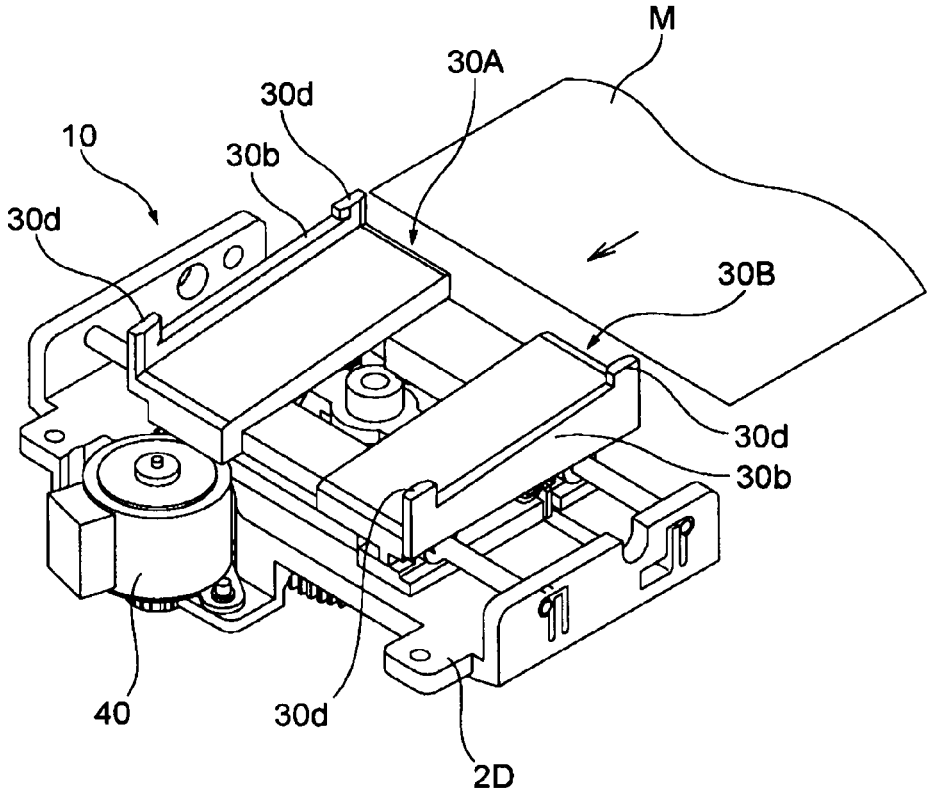
FIG. 21 is a perspective view of the skew correction mechanism to illustrate a state where the pair of movable pieces prevent drawing of the bill.

By this traveling route closing process, the pair of movable pieces 30A and 30B are moved to the minimum width positions (width 52 mm) narrower than a width of any bill to be inserted, and which effectively prevents drawing of a bill thereby. That is, by executing such a bill traveling route closing process, as shown in FIG. 21, a distance between the regulatory walls 30*b* of the respective movable pieces 30A and 30B is made narrower than the width of the bill M, which makes it possible to effectively prevent an action of drawing out the bill M in the arrow direction by an operator for illicit purposes. In particular, in the present embodiment, because the pair of movable pieces 30A and 30B are installed so as to protrude from the bill traveling route 3 as shown in FIGS. 2 and 3, even when an attempt is made to forcibly draw out the bill by attaching a string or the like to a bill, the regulatory walls 30*b* of the movable pieces protrude from the bill traveling route, which makes it possible to exactly prevent such a fraudulent activity.

Further, as described above, the movable piece detecting sensor 51 shown in FIGS. 10 and 11 is configured to sense a position at which the movable piece 30B comes close to the center of the bill traveling route at a maximum (a position at which the movable piece 30B moves to have the minimum width; predetermined position), and to sense the movement when the movable piece 30B moves in the spacing direction.

In this case, when the movable piece detecting sensor 51 senses a movement of the movable piece, it may be adjudged that an operator is committing some fraudulent activity, and the predetermined processes may be executed. For example, a fraudulent manipulated signal (an anomaly sensed signal) may be transmitted to a higher-level apparatus that manages the operations of the bill processing apparatus, or an annunciator lamp may be provided on the bill processing apparatus, and this lamp may flash, or without activating a process for input acceptance (ST21) input by the operator thereafter, a process in which a discharge operation or the like is forcibly carried out may be executed. Or, appropriate processes such as canceling the operation of the bill processing apparatus (for example, a process for stopping the processing, a process for discharging the bill, and the like) and the like may be executed.

As described above, because an attempt is made to prevent a fraudulent activity by utilizing the movable pieces 30A and 30B which are members to eliminate skew as is, there is no need to newly install members for preventing a fraudulent activity and a driving source or the like to drive those according to circumstances, which makes it possible to make an attempt to reduce the cost of the apparatus. Further, in succession to the traveling route closing process described above (ST14), a conveyor roller pair spacing process in which the driving source 70 is driven to allow the conveyor roller pair (14A, 14B) coming to hold the bill therebetween to be spaced from one another is executed (ST15). By executing the conveyor roller pair spacing process, even when an operator additionally inserts (double inserts) a bill by mistake, there are no cases in which a feeding operation by the conveyor roller pair (14A, 14B) is not carried out onto the bill, and because the bill is made to hit the pair of movable pieces 30A and 30B in a closed state at ST14, it is possible to reliably prevent the operation of double-inserting a bill.

At the same time of the bill traveling route closing process, when the bill reading means 8 reads the data up to the back end of the bill, the bill conveyor motor 13 is driven by a given quantity to stop the bill at a predetermined position (an escrow position; a position at which the bill is carried toward the downstream by 13 mm from the center position of the bill reading means 8), and at this time, a bill authenticity judgment process is executed in the control means 200 (ST16 to ST19).

In the bill authenticity judgment process at ST18 described above, when the bill is judged as a legitimate bill (ST20; Yes), an input from the operator is received (ST21). This input corresponds to an acceptance operation in which the operator presses an acceptance button in order to accept provision of service (for example, an acceptance process according to the start of a game in a case of a gaming unit), and a process in which the operator presses a return button in order to execute a process for returning an inserted bill.

Then, when an operation to accept the provision of various types of services is input (ST22; Yes), the bill conveyor motor 13 is driven to normally rotate to carry the bill toward the bill housing part 100 (ST23). Thereafter, when it is sensed that the bill is transferred to the bill housing part 100 (transferred to the press waiting part 108 via the feed port 103) (ST24), the driving to normally rotate the above-described bill conveyor motor 13 is stopped, and the series of processes is completed (ST25).

Thereafter, the motor 20 to drive the above-described presser plate 115 is driven to press the bill transferred to the press waiting part 108 onto the placing plate 105, and a process for housing the bill is executed.

Figure 16:
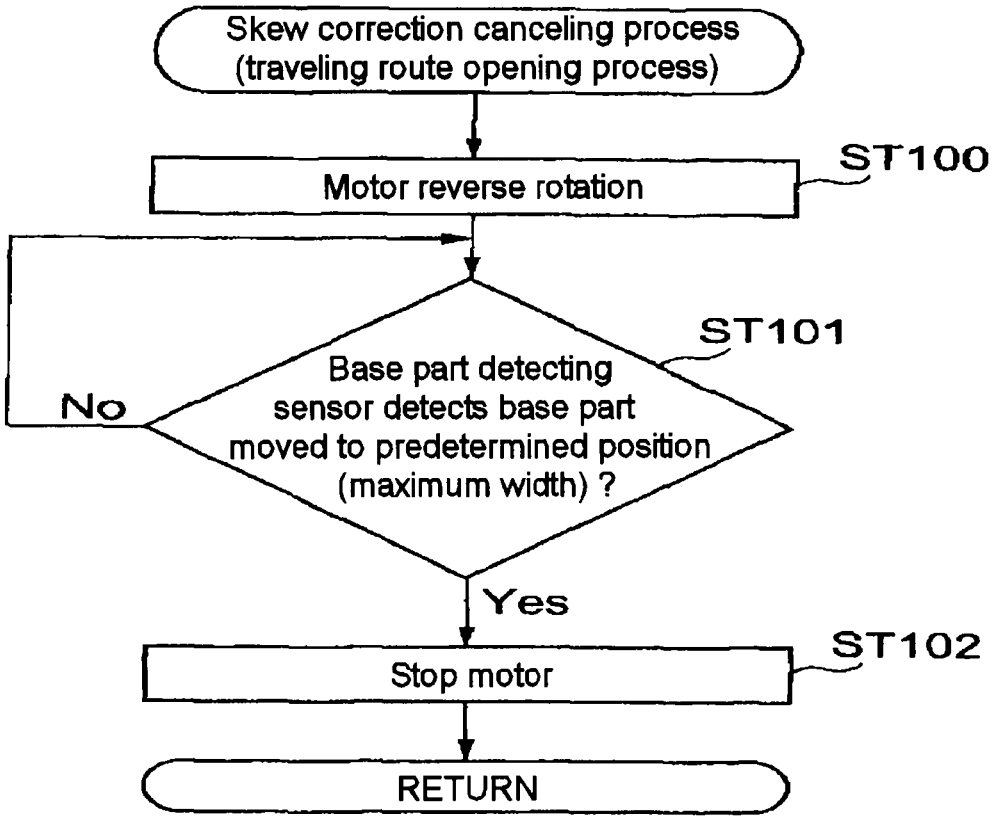
FIG. 16 shows a flowchart illustrating processing operations of a skew correction canceling process.

In addition, at ST20 in the procedure of the processes described above, when the bill is not judged as a legitimate bill, or when the return button is pressed down by the operator (ST22; No), the skew correction canceling process at ST100 to ST102 shown in the flowchart of FIG. 16 is executed (ST50), and the base parts 31A and 31B are moved to the maximum width positions. In this state, the above-described driving source 70 is driven to execute a holding process of the conveyor roller pair (14A and 14B) in a spaced state (ST51), and the bill conveyor motor 13 is driven to reversely rotate to carry the bill waiting at an escrow position toward the bill insertion slot 5 (ST52). Then, when the insertion detecting sensor 7 senses the back end of the bill to be returned toward the bill insertion slot 5, the driving to reversely rotate the bill conveyor motor 13 is stopped, and above-described driving source 70 is driven to allow the conveyor roller pair (14A and 14B) coming to hold the bill therebetween to be spaced from one another (ST53 to ST55). Thereafter, the traveling route closing process at ST120 to ST122 shown in the flowchart of FIG. 18 is executed (ST56), and the base parts 31A and 31B are moved toward the directions in which both come close to one another, and the series of processes is completed.

Figure 14:
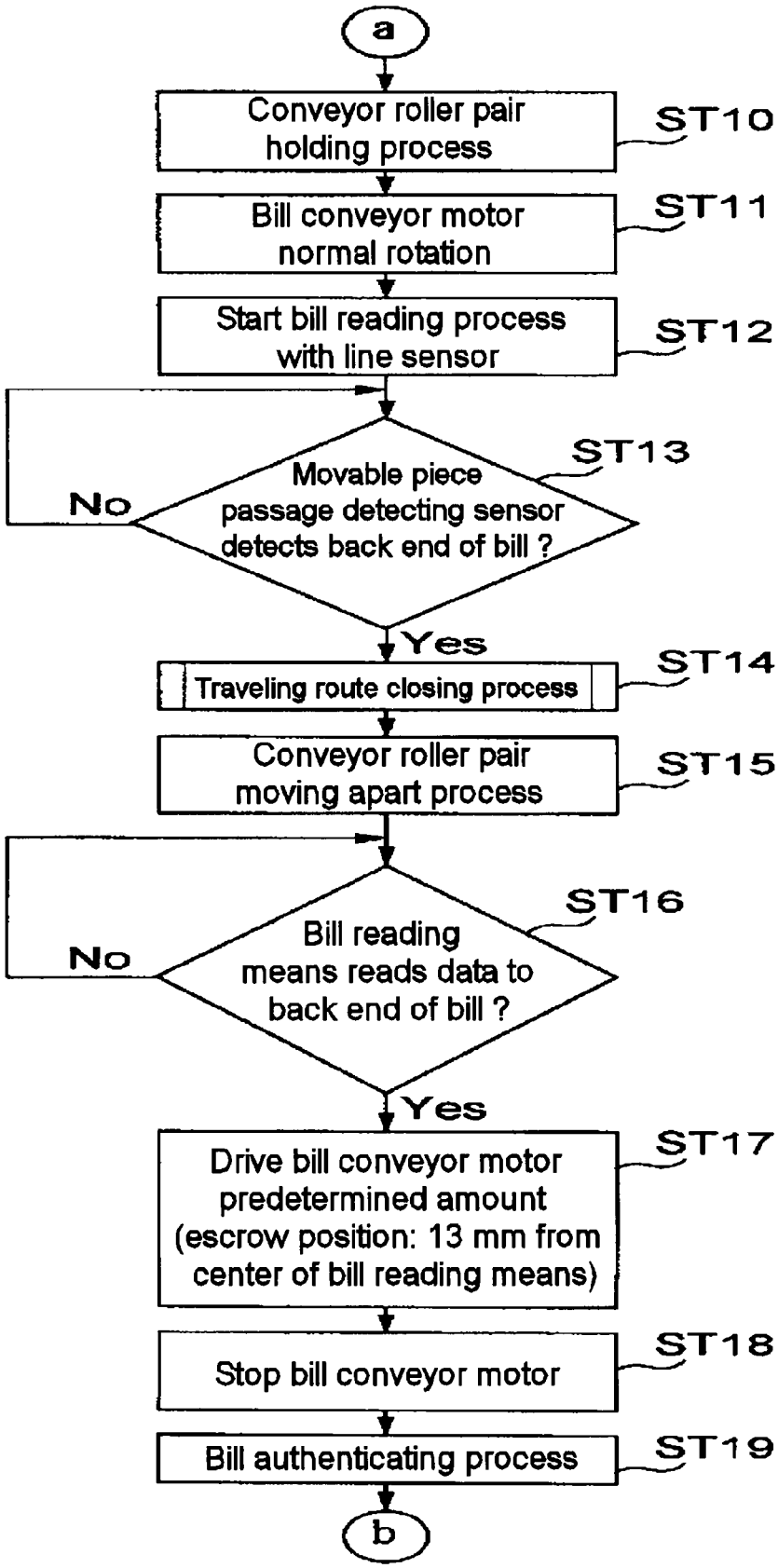
FIG. 14 shows a flowchart (part two) illustrating processing operations for processing a bill in a bill processing apparatus of this embodiment.
Figure 15:
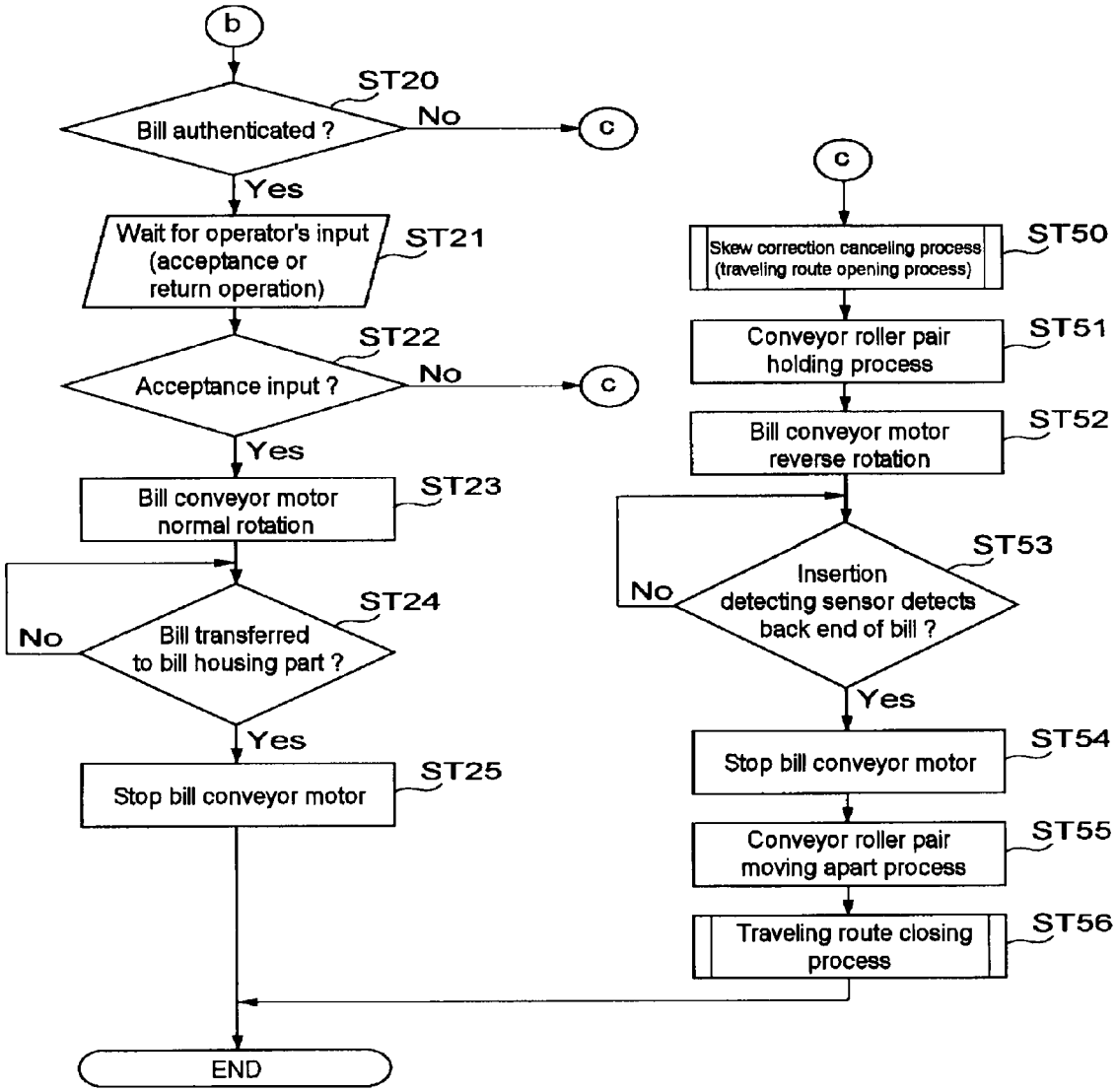
FIG. 15 shows a flowchart (part three) illustrating processing operations for processing a bill in a bill processing apparatus of this embodiment.
Figure 22:
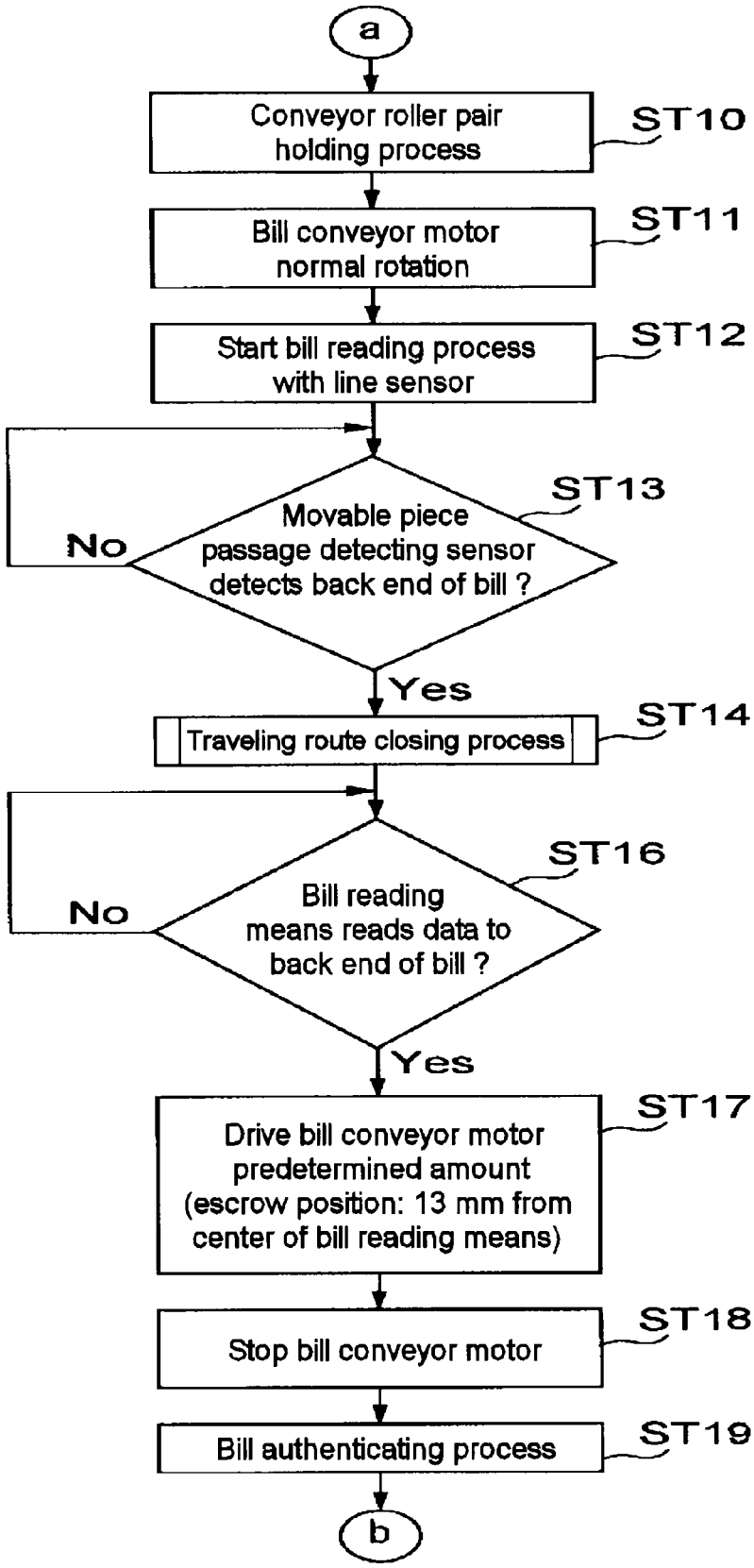
FIG. 22 shows a flowchart (part two) illustrating processing operations for processing a bill in a bill processing apparatus of another embodiment.
Figure 23:
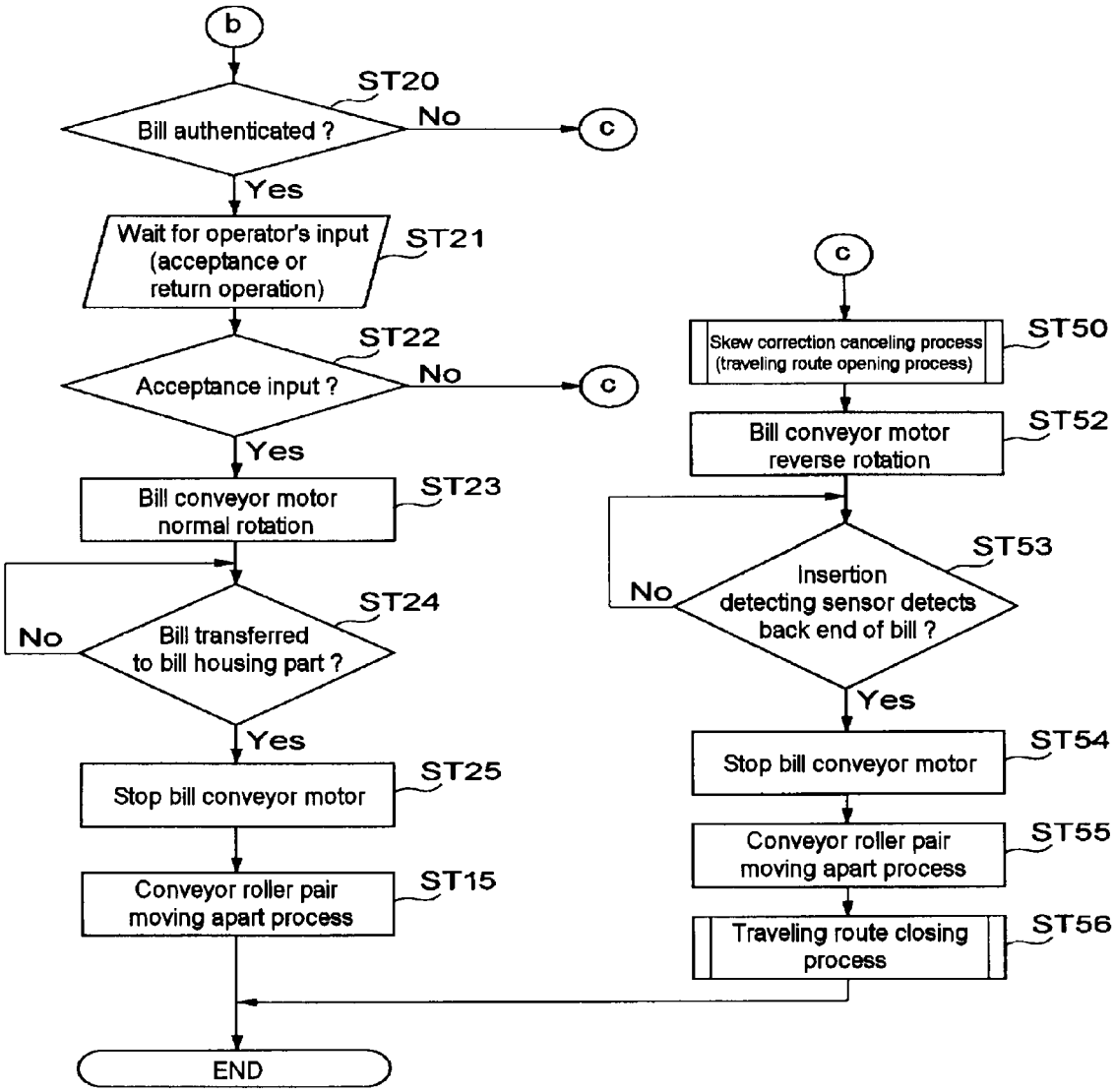
FIG. 23 shows a flowchart (part three) illustrating processing operations for processing a bill in a bill processing apparatus of the other embodiment.

Here, another embodiment which has slightly different flowcharts other than those shown in FIGS. 14 and 15 is described in reference to FIGS. 22 and 23. In FIG. 22, another case in which the conveyor roller pair moving apart process is not executed in subsequent to the traveling route closing process (ST14). In such case, the conveyor roller pair moving apart process (ST15) is conducted as shown in FIG. 23 after the normal rotation of the bill conveyor motor 13 is stopped when it is detected that the bill is transferred to the bill housing part 100 (ST24). In this case, when the return button is pressed down by the operator (ST22; No), the skew correction canceling process from ST100 to ST102 is executed (ST50), the bill conveyor motor 13 is just driven to reversely rotate to convey the bill staying at the escrow position toward the bill insertion slot 5 (ST52).

The embodiment of the present invention has been described above. However, the present invention is not limited to the above-described embodiment, and various modifications can be implemented. In the skew correction mechanism of the bill processing apparatus in the embodiment described above, the base parts and the movable pieces are provided as a pair each on the right and left so as to touch both side edges of a bill to be carried. However, the skew correction mechanism may have a structure in which one edge of a bill is made to touch a base part and a movable piece, and the other edge thereof is made to touch a regulatory wall provided on the bill traveling route of the apparatus main body.

Further, the driving source that drives the various types of driving members described above or the mechanism for transmitting power from the driving source have been merely shown as one example, and modifications thereof are appropriately possible. Further, a structure may be employed in which the above-described bill housing part 100 is not installed in the bill processing apparatus.

The bill processing apparatus of the present invention can be incorporated into various types of apparatuses providing products and services by inserting a bill thereinto for example.

In addition to the abovementioned embodiments, the following example may be included in the present invention.

In the present invention, it is possible to provide a bill processing apparatus comprising: a skew correction mechanism to correct the skew by fixing the direction of the bill such that the possibility that the bill is damaged.

In this embodiment of the present invention, a bill processing apparatus comprising: a skew correction mechanism is provided. Here, the skew correction mechanism comprises: base parts to be driven toward a center of a bill traveling route through which a bill is conveyed by a driving source; movable pieces which are supported by the base parts in a movable manner toward a center of the bill traveling route and regulates side edges of the conveyed bill; and springs pushing the movable pieces toward the center of the bill traveling route, wherein the base parts is movable against a pushing force of the springs when a reaction force of the bill is applied to the driving force as the base parts are driven toward the center of the conveying direction such that the movable pieces hit side edges of the bill.

According to the abovementioned configuration of the bill processing apparatus, when the bill is inserted into the bill insertion slot provided on the apparatus main body, the bill is conveyed to the skew correction mechanism. In this state, the base parts of the skew correction mechanism are driven toward the center direction of the bill traveling route through which the bill is transferred and the movable pieces supported by the base parts via springs also hit the side edges of the bill. Thus, when the movable pieces hit the side edges of the bill so that a reaction force by the bill is applied to the driving source, the base parts are movable for the movable pieces against the pushing force of the springs. That is, the base parts can move toward the center of the bill. Upon movement of the base parts, the movable pieces touching the side edges of the bill do not move toward the center of the bill traveling route, but correct the skew of the bill. Thus, since the movable pieces that are supported by the base parts via the springs correct the skew by touching the side edges of the bill, the load applied to the bill is alleviated and it is possible to adjust easily the center position without causing folding lines or wrinkles on the bill.

In another embodiment, the movable pieces comprise plate-like regulating walls to contact side edges of the conveyed bill.

In such a configuration, contact areas of the bill against the movable pieces are inside portions of the plate-like regulating walls. That is, the contact of the movable pieces against the side edges of the bill is on the plate-like regulating walls such that there are no contacting portions above the side edge areas (the cross-section of the movable piece is not a cup-shape), and the contact area of the movable piece against the bill becomes smaller such that it is possible to prevent the damage of the bill.

In yet another embodiment, an upward projection is provided at least one of the front end and the back end positions of the regulating wall.

In such a configuration, while the skew of the bill is eliminated, the bill does not go over the regulating walls of the movable pieces and it is sure to make the bill aligned along the center line of the bill traveling route.

In a case where the movable pieces contacting on both side edges of the conveyed bill are driven toward each other until the synchronized motor loses the synchronization or shows slip, folding lines or wrinkles on the bill may be caused such that it is possible to generate the conveyance error of the bill. However, in the abovementioned configuration, it is possible to provide a bill processing apparatus in which the bill may not be damaged during the skew correction.

If a structure (the blocking member, the stopper member, and a driving mechanism to drive it, and the like) dedicated for preventing a fraudulent activity to the bill processing apparatus is provided in addition to the above-described components of the bill processing apparatus, and in accordance therewith, there is a possibility that a number of components is increased, and the manufacturing cost thereof rises.

In the present invention, it is possible to provide a bill processing apparatus capable of preventing a fraudulent activity at low cost in view of the above-described circumstances.

Therefore, in the present invention, a bill processing apparatus may comprise movable pieces which are movable toward a center of a bill traveling route through which a bill is carried by a driving source, the movable pieces regulate the side edges of the bill to be carried in parallel with its carrying direction, and a control means that controls the driving of the driving source, and in the bill processing apparatus, after the bill passes through the movable pieces, the control means drives the driving source to move the movable pieces toward the center of the bill traveling route from a position at which the movable pieces touch the side edges of the bill.

In general, in the bill processing apparatus, when a bill is carried to a bill identification part including an identification sensor, it is required to carry the bill in an accurate state (a skew-corrected state), which is not allowed to pass obliquely in order to make an attempt to improve its identification accuracy. Further, because a width differs by class of a bill, it is necessary to feed a bill onto which positioning (centering and the like) is accurately performed into the bill identification part.

In the abovementioned structure, by utilizing the movable pieces installed in order to eliminate skew of a bill to be carried to carry out positioning, after the bill passes through the movable pieces (after skew correction is performed, and positioning is carried out), the movable pieces are moved toward the center of the bill traveling route from the position at which the movable pieces touch the side edges of the bill, which makes it impossible to draw out the bill. In this way, by utilizing the movable pieces serving as members to eliminate skew as is, there is no need to newly install members for preventing a fraudulent activity in order to make an attempt to prevent a fraudulent activity, and an attempt can be made to reduce the cost of the apparatus.

Further, in another embodiment of the present invention, there is provided a sensor that senses the movement of the movable pieces after the movable pieces are moved to the center of the bill traveling route.

In such a configuration, after the movable pieces are moved to the center of the bill traveling route, when the sensor senses the moment of the movable pieces, it is possible to detect a fraudulent activity.

Further, in yet another embodiment of the present invention, the movable pieces are installed so as to protrude from the bill traveling route.

In such a configuration, even when an attempt is made to commit a fraudulent activity such as drawing out a bill, because the movable pieces protrude from the bill traveling route, it is possible to reliably prevent the fraudulent activity.

What is claimed is:

1. A bill processing apparatus, comprising:

a skew correction mechanism, wherein the skew correction mechanism includes:

base parts to be driven by a driving source toward a center of a bill traveling route through which a bill is conveyed;

movable pieces which are supported at a fixed angle by the base parts in a movable manner toward a center of the bill traveling route and regulate side edges of the conveyed bill, the base parts being axially movable with respect to guide members extending in a direction perpendicular to the bill traveling route and inserted into through-holes formed in respective pairs of flanges of the base parts; and springs pushing the movable pieces toward the center of the bill traveling route, each of the springs being interposed between one of the respective pairs of flanges of the base parts and a flange of each of the movable pieces, wherein the base parts move against a pushing force of the springs when a reaction force of the bill is applied to the driving force as the base parts are driven toward the center of the bill traveling route such that the movable pieces hit side edges of the bill.

2. The bill processing apparatus according to claim 1, wherein the movable pieces comprise regulation walls to contact side edges of the conveyed bill, and the movable pieces are driven by the driving source via a pinion positioned between the guide members and racks formed on the base parts.

3. The bill processing apparatus according to claim 2, wherein an upward projection is disposed on a top end of at least one of the regulation walls.

* * * * *